US011199331B2

(12) United States Patent
Mills et al.

(10) Patent No.: US 11,199,331 B2
(45) Date of Patent: Dec. 14, 2021

(54) COOKING OVEN WITH CAVITY DRAWER HAVING MOVABLE DOOR

(71) Applicant: Electrolux Home Products, Inc., Charlotte, NC (US)

(72) Inventors: Christopher Mills, Gallatin, TN (US); Randy Anderson, Clarksville, TN (US); Todd Brooks, Gallatin, TN (US); Santosh Venkappa Pujer, Bengaluru (IN); Kiran Kumar Rao, Mangalore (IN); Vikas Venkatramana Naik, Bangalore (IN)

(73) Assignee: Electrolux Home Products, Inc., Charlotte, NC (US)

( * ) Notice: Subject to any disclaimer, the term of this patent is extended or adjusted under 35 U.S.C. 154(b) by 144 days.

(21) Appl. No.: 16/598,016

(22) Filed: Oct. 10, 2019

(65) Prior Publication Data

US 2021/0108802 A1 Apr. 15, 2021

(51) Int. Cl.
*F24C 15/02* (2006.01)
*F24C 15/16* (2006.01)

(52) U.S. Cl.
CPC ..... *F24C 15/162* (2013.01); *F24C 15/023* (2013.01)

(58) Field of Classification Search
CPC .... F24C 15/022; F24C 15/162; F24C 15/023; F24C 15/02; F24C 15/028; F24C 15/16
See application file for complete search history.

(56) References Cited

U.S. PATENT DOCUMENTS

| | | | | |
|---|---|---|---|---|
| 574,336 | A | 12/1896 | Koch | |
| 1,851,853 | A | 3/1932 | Lindemann | |
| 1,851,854 | A | 3/1932 | Lindemann et al. | |
| 1,851,855 | A | 3/1932 | Lindemann et al. | |
| 1,865,212 | A | 6/1932 | Rogers et al. | |
| 1,960,365 | A * | 5/1934 | Barker | F24C 15/16 312/400 |
| 1,970,343 | A * | 8/1934 | Sherman | F24C 15/162 126/340 |
| 2,088,719 | A * | 8/1937 | Pierson | F24C 15/162 312/269 |
| 2,127,146 | A | 8/1938 | Smallen | |
| 2,132,737 | A | 10/1938 | Kahn | |
| 2,296,950 | A * | 9/1942 | Roedl | F24C 15/162 312/269 |
| 2,649,085 | A * | 8/1953 | Hurt | F24C 15/023 126/41 D |

(Continued)

*Primary Examiner* — Alfred Basichas
(74) *Attorney, Agent, or Firm* — Pearne & Gordon LLP

(57) ABSTRACT

An oven including a chamber defining an oven cavity with an open front. A rack assembly is slidable between a retracted position and an extended position relative to the chamber. A door is provided for closing the open front. A hinge assembly connects the door to the rack assembly. The hinge assembly allows the door to slide between a first position and a second position with respect to the rack assembly. The hinge assembly includes a lock assembly for locking the rack assembly in the extended position. The lock assembly is moveable between a locked position and an unlocked position. The lock assembly is in the unlocked position when the door is in the first position thereby allowing the rack assembly to freely moved, and the lock assembly is in the locked position when the door is in the second position thereby securing the rack assembly in the extended position.

20 Claims, 24 Drawing Sheets

(56) References Cited

U.S. PATENT DOCUMENTS

| | | | | |
|---|---|---|---|---|
| 4,335,292 | A | 6/1982 | Tanaka et al. | |
| 4,729,616 | A | 3/1988 | Vogt | |
| 4,790,146 | A | 12/1988 | Mun et al. | |
| 5,042,454 | A | 8/1991 | Danise | |
| 6,539,840 | B2 | 4/2003 | Choi et al. | |
| 7,587,907 | B2 | 9/2009 | Kim et al. | |
| 7,591,516 | B2 | 9/2009 | Kim et al. | |
| 7,607,444 | B2 | 10/2009 | Gunnerson et al. | |
| 7,712,852 | B2 | 5/2010 | Choi et al. | |
| 7,770,986 | B1 | 8/2010 | Simaitis | |
| 7,994,457 | B2 | 8/2011 | Yoshidome | |
| 8,162,330 | B2 | 4/2012 | Melkumyan et al. | |
| 8,231,190 | B2 | 7/2012 | Ertz et al. | |
| 8,544,970 | B2 | 10/2013 | Jung et al. | |
| 8,549,872 | B2 | 10/2013 | Kwon et al. | |
| 8,641,156 | B2 | 2/2014 | Chow | |
| 8,955,352 | B2 | 2/2015 | Lee et al. | |
| 9,307,888 | B2 | 4/2016 | Baldwin et al. | |
| 9,863,645 | B2 | 1/2018 | Adelmann et al. | |
| 2004/0112371 | A1* | 6/2004 | Le | F24C 15/168 126/334 |
| 2005/0205081 | A1 | 9/2005 | Barker et al. | |
| 2006/0043849 | A1 | 3/2006 | Oh et al. | |
| 2015/0033786 | A1 | 2/2015 | Mansfield et al. | |
| 2015/0354828 | A1* | 12/2015 | Adelmann | F24C 15/023 126/19 R |
| 2015/0354829 | A1* | 12/2015 | Adelmann | F24C 15/162 126/19 R |
| 2015/0354830 | A1 | 12/2015 | Adelmann et al. | |
| 2016/0195279 | A1 | 7/2016 | Naber et al. | |
| 2016/0195280 | A1 | 7/2016 | Adelmann et al. | |
| 2020/0378613 | A1 | 12/2020 | Dankwardt et al. | |

* cited by examiner

COOKING OVEN WITH CAVITY DRAWER HAVING MOVABLE DOOR

BACKGROUND

Conventional cooking ovens include cooking cavities with embossed side walls for allowing cooking racks to slide into and out of the cooking cavity. The cooking racks are usually fabricated from steel wire. When a user withdraws the rack from the oven, the user must grasp the hot rack. However, there is a risk that the user can be burned if proper protection, such as oven gloves, is not used.

Recently, cooking ovens have been designed with smaller oven cavities or dual cooking cavities wherein an upper cavity is smaller than a lower cavity. Due to the size of the small oven cavities, it can be difficult to remove safely a container, such as a tray or pan, from the small oven cavity. The small size of the oven cavity also makes it difficult to view the food items in the cavity without opening oven door or to interact with the food item, such as insert a cooking thermometer into the food item.

The present application is directed to an arrangement for allowing a user to easily and safely access items within an oven cavity.

SUMMARY

There is provided an oven including a chamber defining an oven cavity with an open front. A rack assembly is slidable between a retracted position and an extended position relative to the chamber. A door is provided for closing the open front of the chamber. A hinge assembly connects the door to the rack assembly. The hinge assembly allows the door to slide between a first position and a second position with respect to the rack assembly. The hinge assembly includes a lock assembly for locking the rack assembly in the extended position. The lock assembly is moveable between a locked position and an unlocked position. The lock assembly is in the unlocked position when the door is in the first position thereby allowing the rack assembly to freely moved between the retracted position and the extended position, and the lock assembly is in the locked position when the door is in the second position thereby securing the rack assembly in the extended position.

There is also provided an oven including a chamber defining an oven cavity with an open front. A rack assembly is slidable relative to the chamber between a retracted position and an extended position. The rack assembly includes a door for closing the open front of the chamber when the rack assembly is in the retracted position. A hinge assembly is attached to the door. The hinge assembly is configured to allow the door to slide between a first position and a second position. The second position is vertically below the first position. A slide assembly is connected to the hinge assembly for spacing the door from the open front of the chamber when the rack assembly is in the extended position. A lock assembly is provided for locking the rack assembly in the extended position. The lock assembly is moveable between a locked position and an unlocked position. The lock assembly is in the unlocked position when the door is in the first position thereby allowing the rack assembly to freely move between the retracted position and the extended position, and the lock assembly is in the locked position when the door is in the second position thereby securing the rack assembly in the extended position.

There is further provided an oven including a chamber defining an oven cavity with an open front. A rack assembly is slidable relative to the chamber between a retracted position and an extended position. The rack assembly includes a door for closing the open front of the chamber when the rack assembly is in the retracted position. A hinge assembly is attached to the door. The hinge assembly is configured to allow the door to pivot between a vertical position and a first horizontal position and to slide between the first horizontal position and a second horizontal position. A slide assembly is connected to the hinge assembly for spacing the door from the open front of the chamber when the rack assembly is in the extended position. A lock assembly is provided for locking the rack assembly in the extended position. The lock assembly is moveable between a locked position and an unlocked position. The lock assembly is in the unlocked position when the door is in the vertical position or the first horizontal position, or between the vertical position and the first horizontal position thereby allowing the rack assembly to freely move between the retracted position and the extended position. The lock assembly is in the locked position when the door is in the second horizontal position thereby securing the rack assembly in the extended position.

DETAIL DESCRIPTION OF PREFERRED EMBODIMENTS

Figure 1:
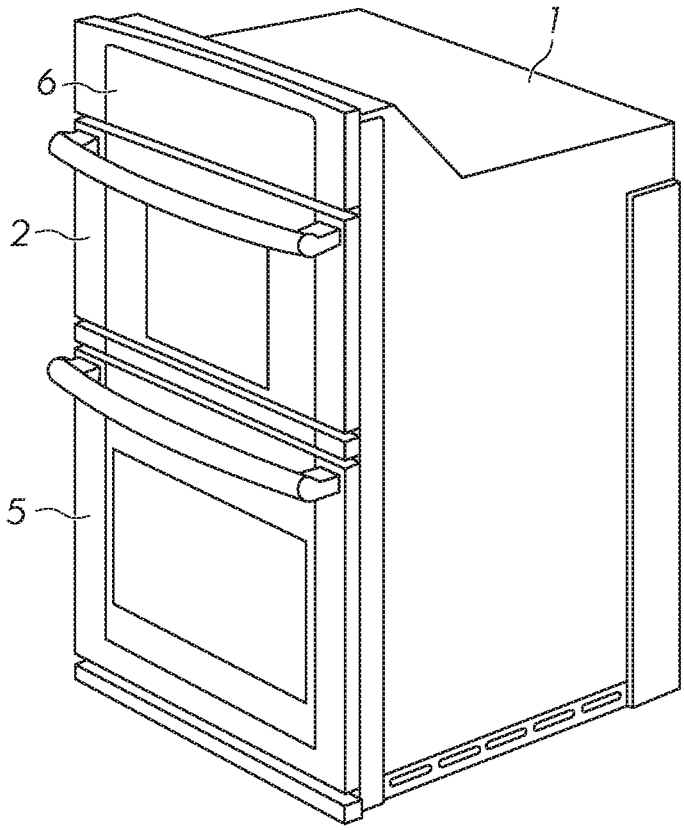
FIG. 1 is a front perspective view a conventional cooking oven with an upper oven and a lower oven.

Referring now to the drawings, FIG. 1 depicts an oven appliance in the form of a dual domestic oven, indicated generally at 1. Although the detailed description that follows concerns a domestic dual oven 1, the invention can be embodied by oven appliances other than a domestic dual oven that includes an upper oven 2 and a lower oven 5.

Figure 2A:
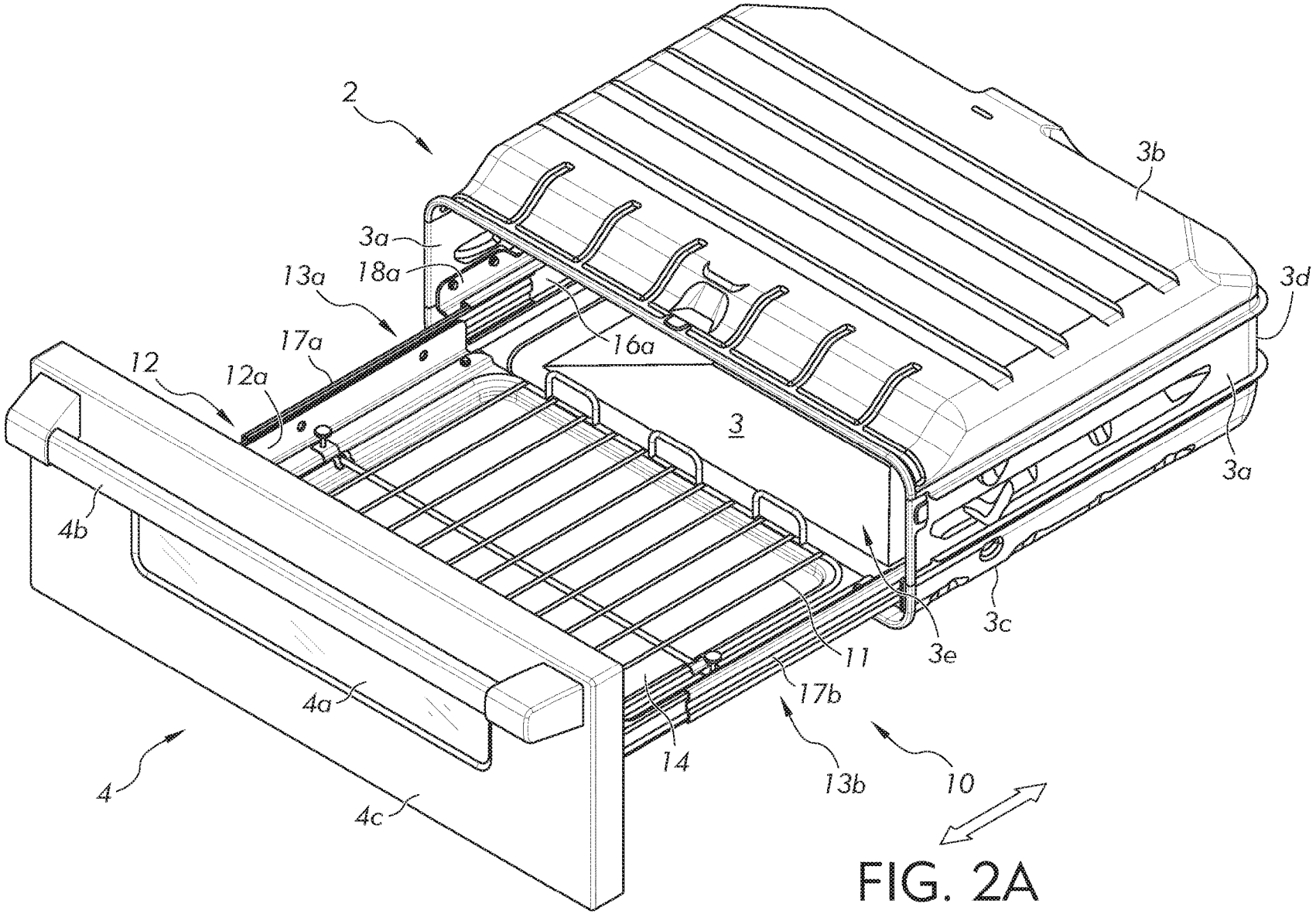
FIG. 2*a* is a front perspective view of the upper oven of FIG. 1 showing a rack assembly of the upper oven in an extended position and a door of the rack assembly in an upper position.

As shown in FIG. 2*a*, the upper oven 2 includes a chamber having opposing side walls 3*a*, an upper wall 3*b*, a lower wall 3*c*, and a rear wall 3*d* that together define an upper cavity 3 of the upper oven 2. The upper oven 2 includes an open front 3*e* that is closed by an upper oven door 4 of a slidable rack assembly 10. The door 4 includes a window 4*a* for allowing a user to view the contents of the oven 2 and a handle 4*b* for opening the door 4.

As shown in FIG. 1, the oven appliance 1 is designed to be a built-in appliance having a display/control panel 6. However, it is contemplated that the oven appliance 1 can also be designed as a free-standing appliance having a traditional cooktop on top of the appliance (not shown).

Figure 2B:
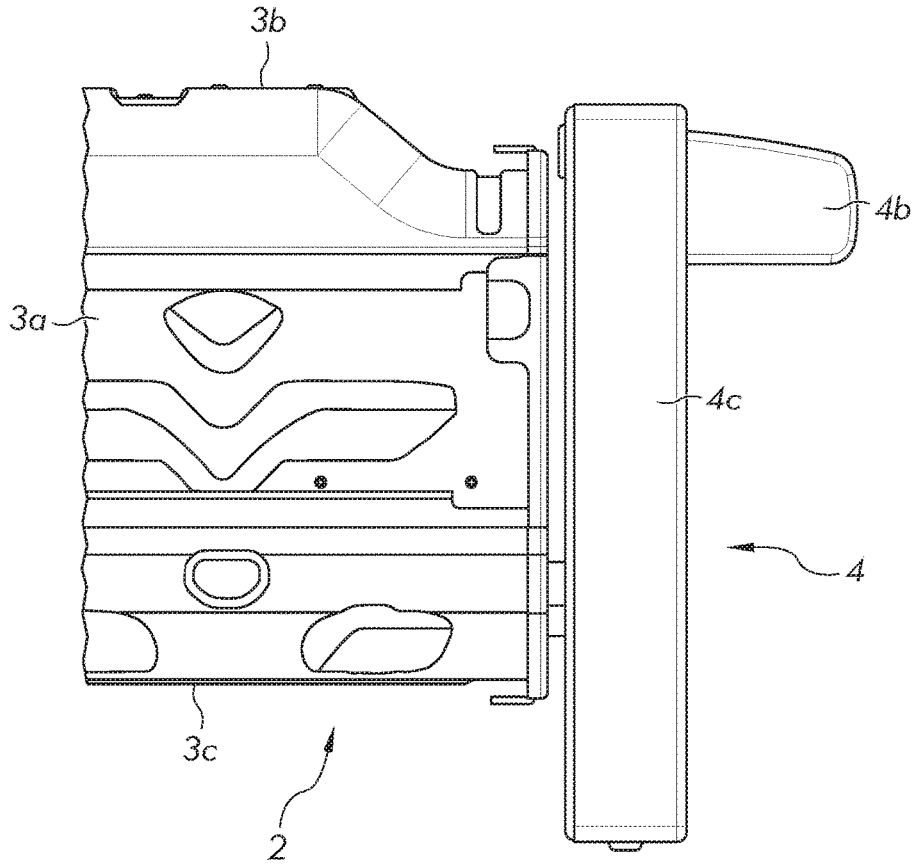
FIG. 2*b* is a left side view of the upper oven of FIG. 2*a* partially cut away, showing the rack assembly in a retracted position.
Figure 2C:
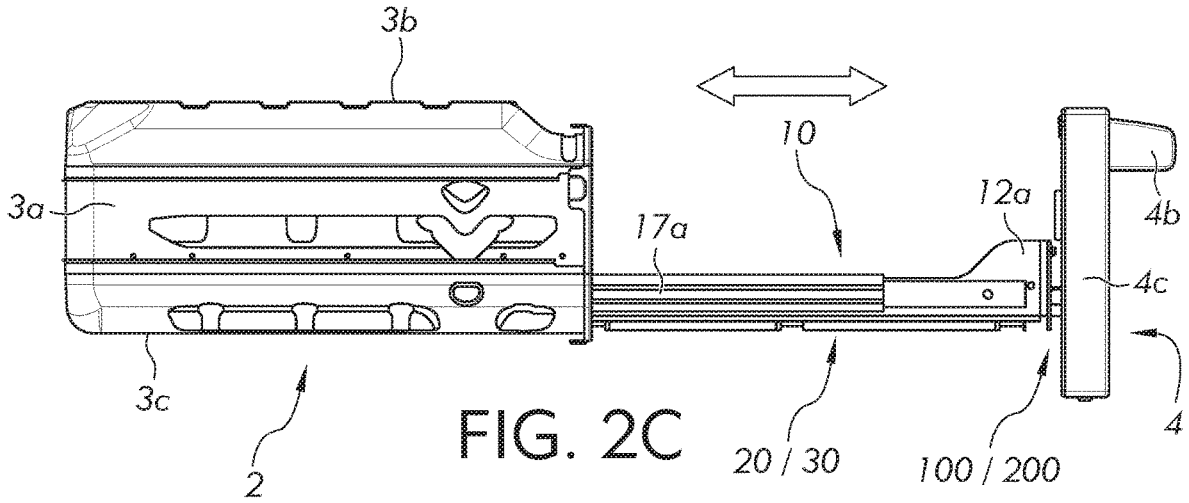
FIG. 2*c* is a left side view of the upper oven of FIG. 2*a* showing the rack assembly in an extended position.

FIGS. 2*a*-2*c* depict the slidable rack assembly 10 that is movable relative to the upper oven cavity 3. Particularly, the rack assembly 10 is slidable such that in a retracted, closed position as depicted in FIG. 2*b*, the rack assembly 10 is fully received within the cooking cavity 3 and the door 4 closes the open front 3*e* of cooking cavity 3. Whereas in an extended position as depicted in FIGS. 2*a* and 2*c*, the door 4 is drawn away and spaced from the cooking cavity 3, thereby extending the rack assembly 10 therefrom, such that the rack assembly 10 and a cooking rack 11 thereon are at least partially withdrawn or removed from the cooking cavity 3 allowing access to the cooking rack 11.

In general, as shown in FIG. 2*a*, the rack assembly 10 includes a frame 12 (made up of components 12*a*, 12*b*, and 12*c*, discussed below), first and second slide assemblies 13*a* and 13*b*, a hinge assembly 100/200 (FIG. 2*c*), the door 4, and a lock assembly 20/30 (FIG. 2*c*).

Referring to FIG. 2*a*, the frame 12 includes or supports a pan 14 that defines a surface for supporting the cooking rack 11. In the embodiment shown, the frame 12 is a rectangular-shaped component for receiving a similarly shaped rack 11. It is contemplated that the rack 11 may be removable from or formed to be integral with the frame 12. Referring to FIG. 3, the frame 12 includes two longitudinal sides 12*a*, 12*b* for attaching to the first and second slide assemblies 13*a*, 13*b*, respectively, and supporting the pan 14 (not shown in FIG. 3). Each of the side members 12*a*, 12*b* includes a laterally extending flange element (not labeled) at its forward end, possessing a respective slot 15*a*, 15*b*. A front bracket 12*c* of the frame 12 extends between opposing side members 12*a*, 12*b* and is assembled to the flange elements thereof. The front bracket 12*c* has slots 15*c* on opposite ends thereof that align with the respective slots 15*a*, 15*b* of the side members 12*a*, 12*b* when assembled. The slots 15*c* are slightly taller and wider than the slots 15*a*, 15*b*. In addition to slots 15*a*, 15*b*, the flange element of each side member 12*a*, 12*b* also include tabs 15*d* that are bent inwardly from the flange elements and support rods 15*e* (see FIG. 2D) that extend from the tabs 15 to the non-flanged arms of side members 12*a*, 12*b*. The rods 15*e* sit behind the aligned slots 15*a*, 15*c* and 15*b*, 15*c* when the side members 12*a*, 12*b* are assembled with the front backet 12*c*. The respective slots 15*a*, 15*b* and 15*c* as well as the rods 15*e* assist in engaging the hinge assemblies 100/200, as described in detail below.

The first and second slide assemblies 13*a*, 13*b* each include a fixed arm 16*a*, 16*b* that is fixed to a respective cavity bracket 18*a*, 18*b* attached to one of the opposing side walls 3*a* of the cooking cavity 3. A movable arm 17*a*, 17*b* is longitudinally extendable from and into the respective fixed arm 16*a*, 16*b*. The fixed arms 16*a*, 16*b* and the movable arms 17*a*, 17*b* are configured to be movable in a telescoping manner relative to each other. In particular, the movable arms 17*a*, 17*b* are configured to extend from the oven cavity 3. The movable arms 17*a*, 17*b* are attached to the longitudinal sides 12*a*, 12*b* of the frame 12 such that movement of the arms 17*a*, 17*b* out of the oven cavity 3 causes the frame 12 to move out of the oven cavity 3 between the retracted position (see FIG. 2*b*) and the extended position (see FIGS. 2*a* and 2*c*).

Figure 2D:
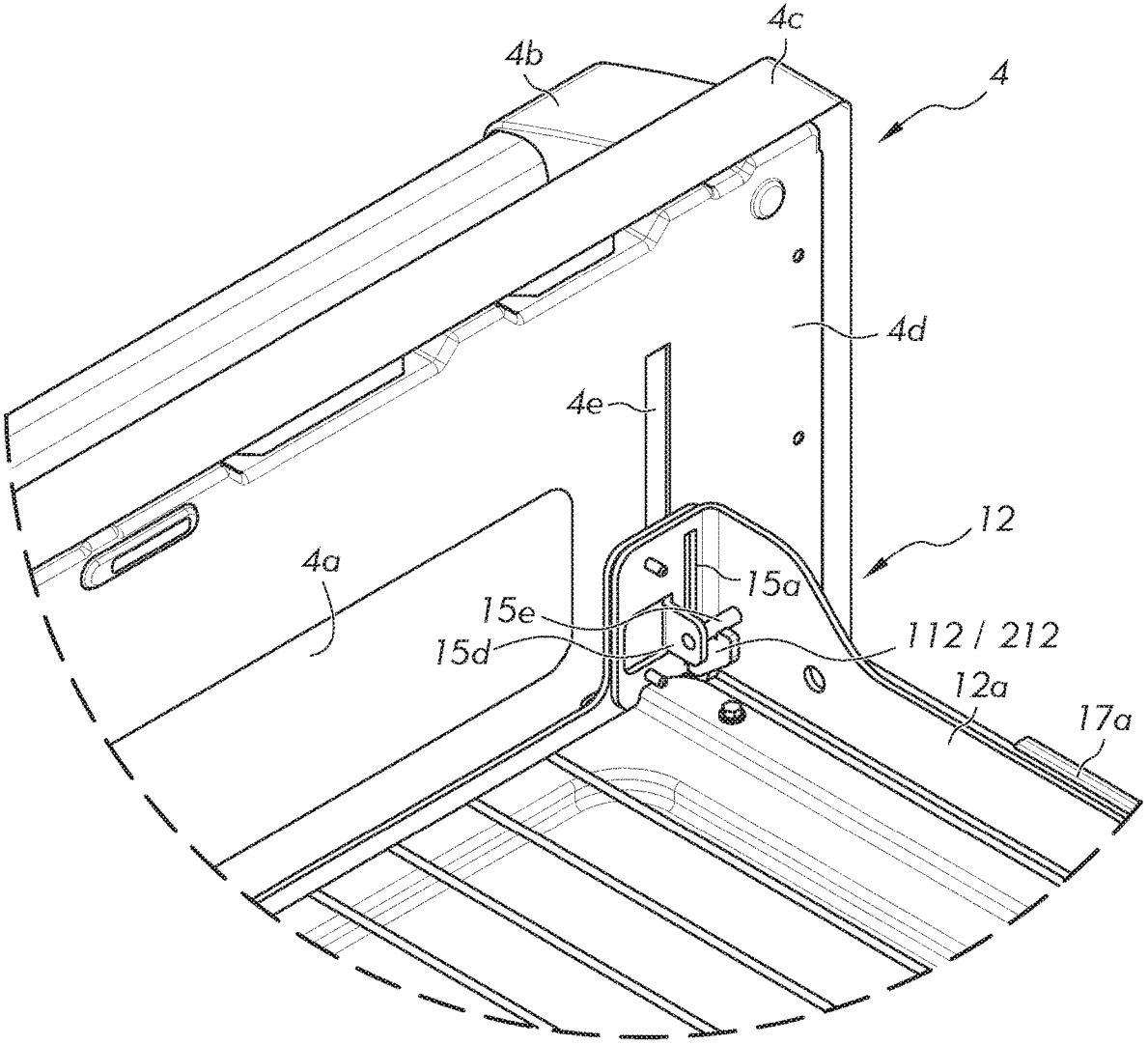
FIG. 2*d* is an enlarged interior perspective view of a left side of the rack assembly of FIG. 2*a* partially cut away, showing the left hinge of FIG. 7*a* attached to the frame assembly of FIG. 3.
Figure 3:
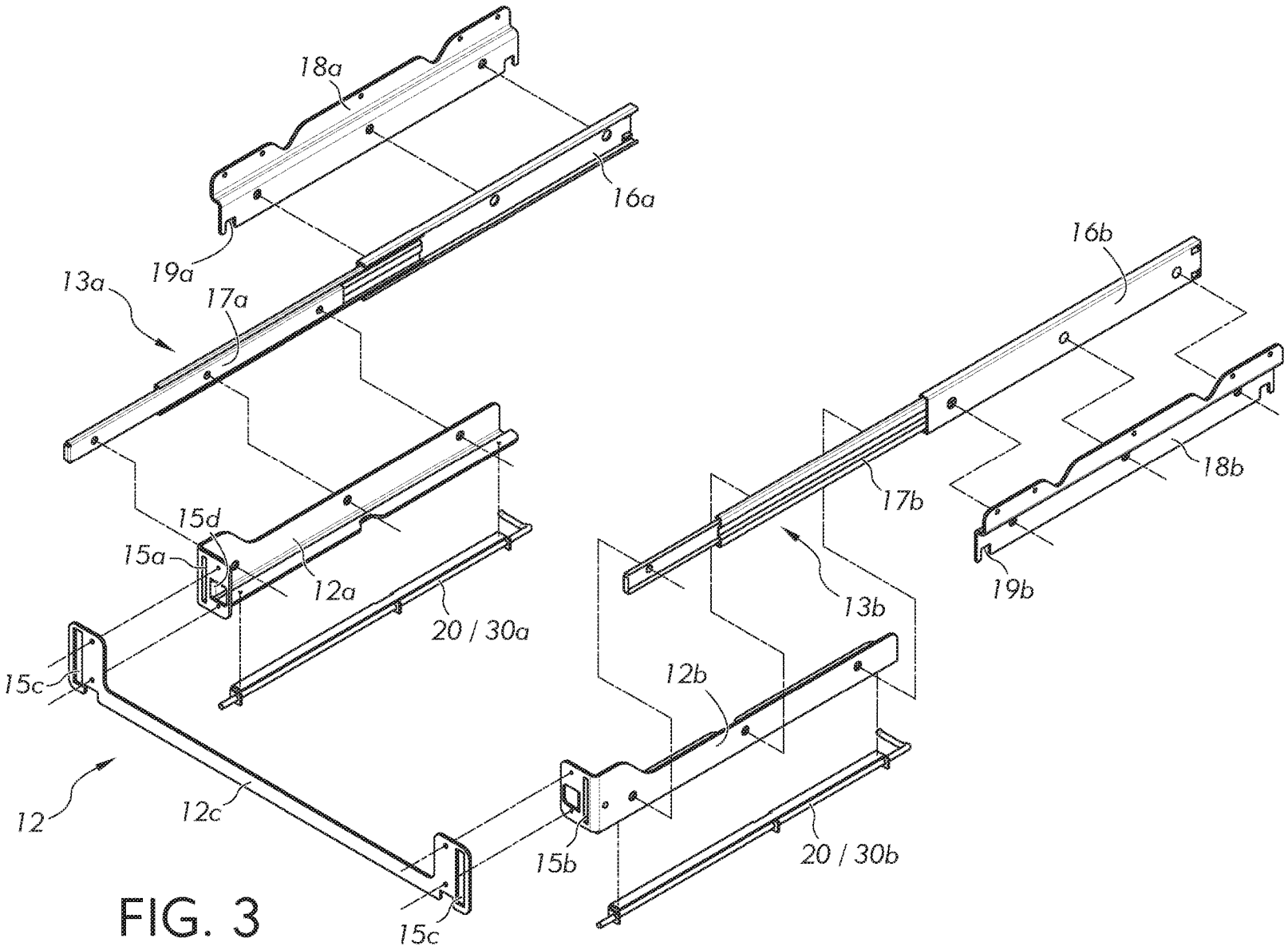
FIG. 3 is an exploded view of a frame assembly of the rack assembly of FIG. 2*a;*

Referring now to FIG. 2*d*, the door 4 is attached to the frame 12. The door 4 in general includes a front panel 4*c* and an inner panel 4*d*. The front panel 4*c* may be contoured and/or made from a material that is aesthetically pleasing to a user. The handle 4*b* on the door 4 is configured such that a user can easily grasp the handle 4*b* to move the door 4, and in turn the rack assembly 10, to a desired position. The inner panel 4*d* includes vertical slots 4*e* for allowing an arm 110/210 of the respective hinge assembly 100/200 to slide vertically therein, as described in detail below.

Figure 4:
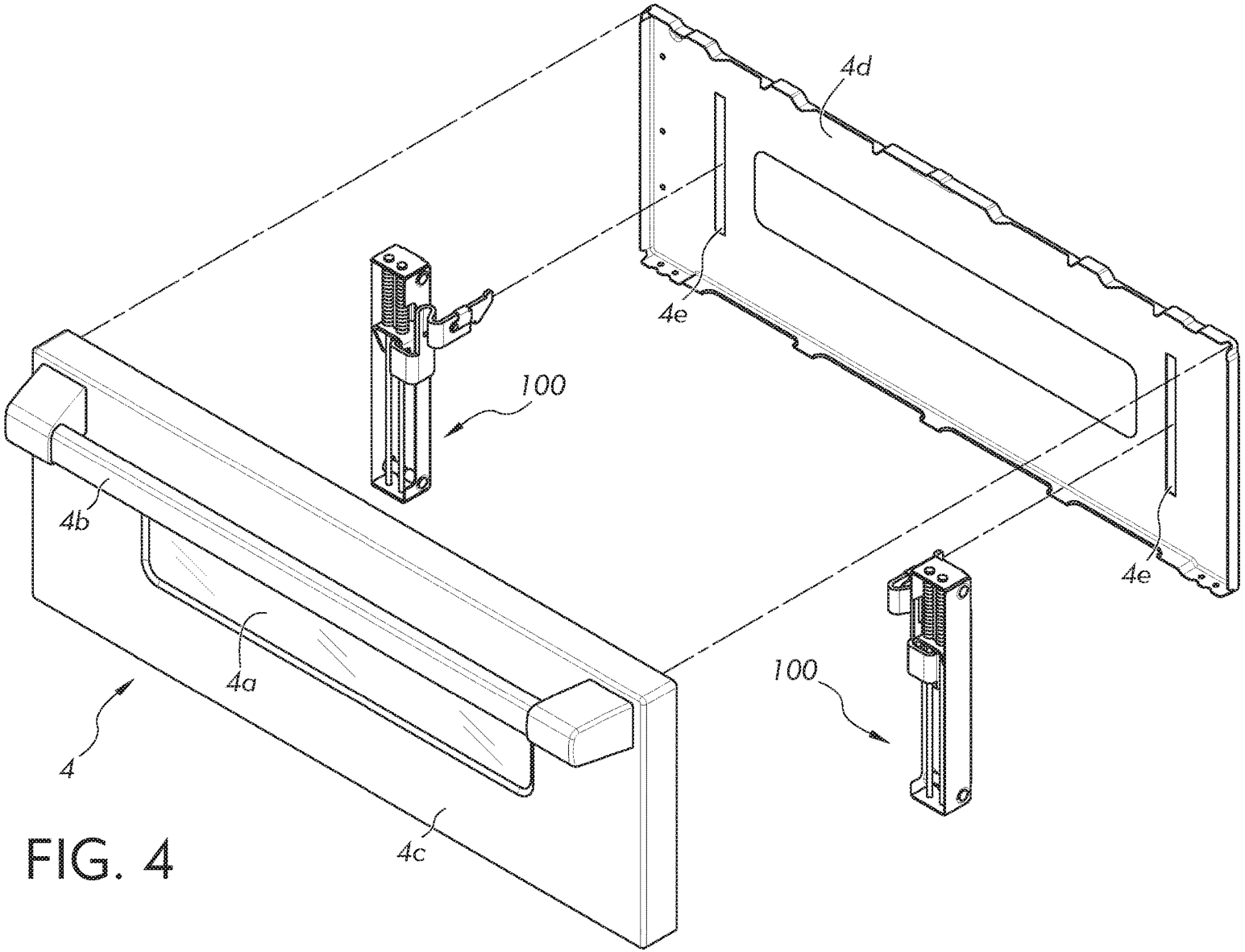
FIG. 4 is an exploded view an oven door including the right hinge assembly of FIG. 6 and the left hinge assembly of FIG. 7*a;*

Referring now FIG. 4, two hinge assemblies 100, the front panel 4c with the handle 4b attached thereto, and the inner panel 4d, all of which are part of door 4, are shown in an exploded view.

Figure 6:
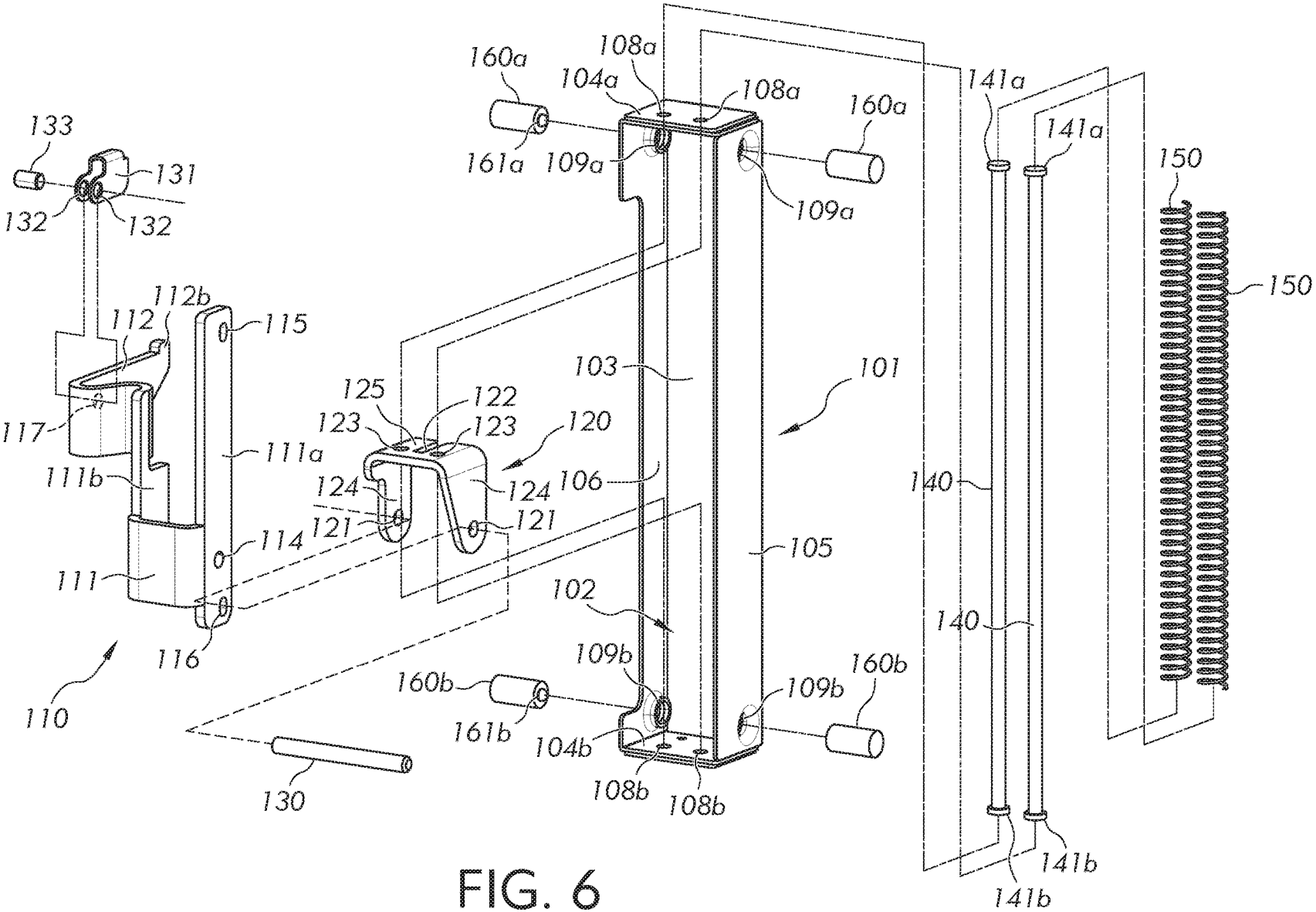
FIG. 6 is an exploded view of a right hinge assembly of the rack assembly of FIG. 5*a;*
Figure 7A:
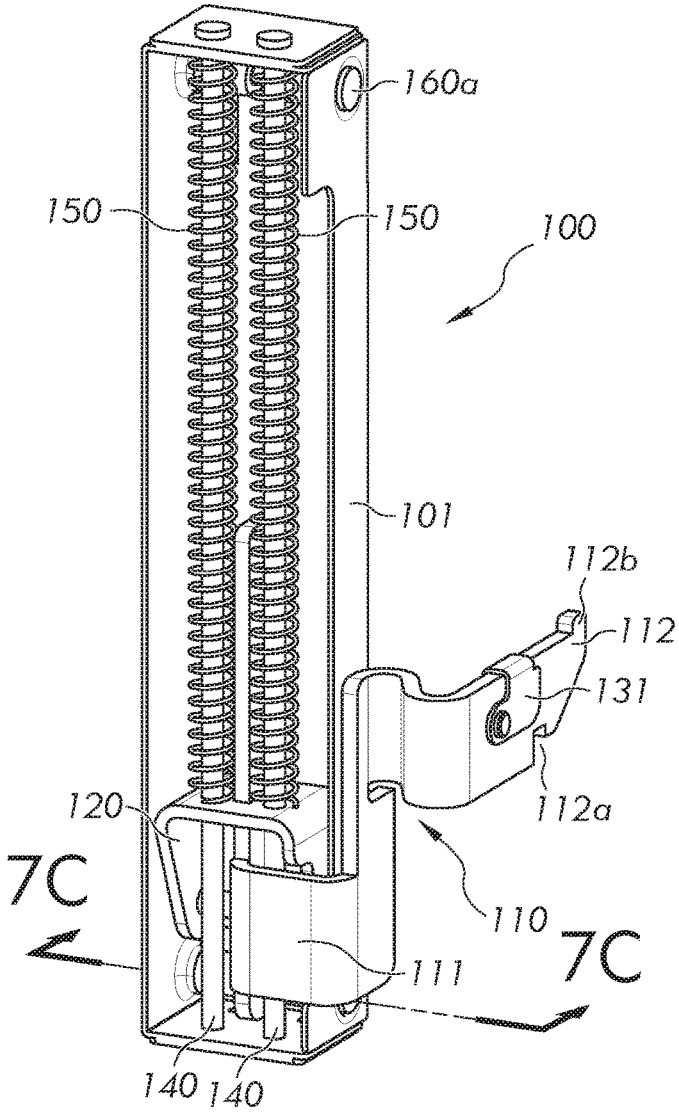
FIG. 7*a* is a front perspective view of a left hinge assembly of the rack assembly of FIG. 5*a;*
Figure 7B:
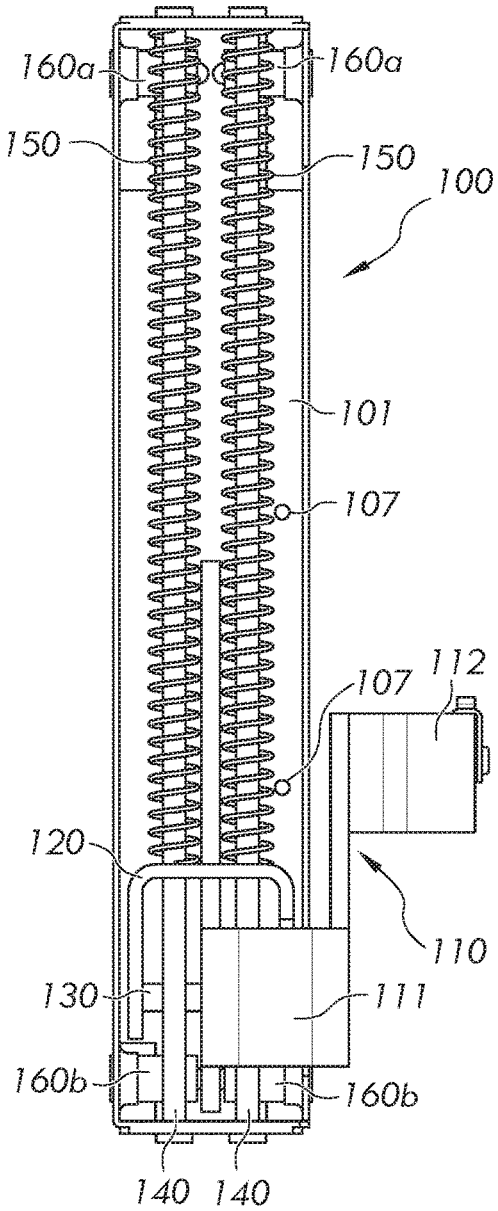
FIG. 7*b* is a front plane view of the left hinge assembly of FIG. 7*a;*

In a first embodiment shown in FIG. 6, the hinge assembly 100 includes a housing 101, a pair of shafts 140, a hinge bracket 120, and a hinge arm 110. FIG. 6 illustrates the right hinge assembly 100, whereas FIGS. 7a and 7b illustrate the left hinge assembly 100. Except the arms 110 of the respective hinge assemblies 100 (which are mirror images of each other), the left hinge assembly 100 and the right hinge assembly 100 are identical.

FIG. 6 shows an exploded view of the components of the hinge assembly 100. The housing 101 includes a rear wall 103, a top wall 104a, a bottom wall 104b, a first side wall 105 and a second side wall 106 that together define a receiving space 102 for housing the other components of the hinge assembly 100. The rear wall 103 may include holes 107 (FIG. 7b) dimensioned to receive fasteners (not shown) for mounting the hinge housing 101 to the door 4. Two upper shaft holes 108a extend through the top wall 104a of the housing 101 and two lower shaft holes 108b extend through the bottom wall 104b of the housing 101. The shaft holes 108a, 108b are positioned and dimensioned as described in detail below. Two upper plunger holes 109a extend through the first side wall 105 and the second side wall 106 of the housing 101. The plunger holes 109a are dimensioned and positioned as described in detail below.

The shafts 140 are dimensioned to extend through the two upper shaft holes 108a and the two lower shaft holes 108b. As shown, the shafts 140 are elongated, rod-shaped elements having a knob 141a, 141b at either end. Each shaft 140 is dimensioned to extend through one upper shaft hole 108a and a corresponding, coaxially aligned lower shaft hole 108b. The shafts 140 are dimensioned such that at least one of the knobs 141a, 141b is removable to allow the shaft 140 to extend through the holes 108a, 108b. The knob 141a/141b may then be reattached to secure the shaft 140 to the housing 101 (see FIGS. 7a and 7b). It is also contemplated that the shafts 140 could be secured to the housing 101 using other methods, such as, but not limited to, threads, welding, adhesives, nuts, etc.

As shown in FIG. 6, the hinge bracket 120 is a generally U-shaped component having opposing legs 124 extending from a common base portion 125. A hole 121 extends through each leg 124. The holes 121 in the legs are coaxially aligned with each other. Two holes 123 extend through the base portion 125 for slidably receiving the shafts 140. A notch 122 is formed in an edge of the bracket 120 for receiving a portion (first leg 111a) of the hinge arm 110 as discussed in detail below.

The hinge arm 110 includes a first arm section 111 that is U-shaped and includes the first leg 111a and a second leg 111b. A hole 114 extends through the first leg 111a and is dimensioned and positioned to coaxially align with the holes 121 extending through the legs 124 of the hinge bracket 120 when the hinge arm 110 is attached to the bracket 120. The holes 121 in the bracket 120 and the hole 114 in the first leg 111a are dimensioned and positioned to allow a pin 130 to extend therethrough to secure the bracket 120 and the arm 110 together. The first leg 111a also includes an upper hole 115 and a lower hole 116, the dimensions and positions of which are described in detail below. A second arm section 112 extends from the second leg 111b of the hinge arm 110. The second arm section 112 includes an elongated portion that extends through the slots 4e in the inner panel 4d of the door 4 for securing the door 4 to the frame 12 as discussed in greater detail below. The second arm section 112 includes a hole 117 for receiving a pin 133. A clip 131 is dimensioned having opposing planar portions with respective holes 132, which are configured to fit over the second arm section 112 upon assembly, such that its holes 132 coaxially align with the hole 117 to commonly receive and accommodate the pin 133 therethrough. The second arm section 112 also includes a notch 112a extending inward from a lower edge thereof and a protrusion 112b extending upward from an upper edge thereof (see FIG. 7A). As depicted, the hinge arm 110 is a formed element that includes whose first and second arm sections 111 and 112 are commonly and integrally formed together as a single-piece part. It is contemplated that the first arm section 111 and the second arm section 112 may be separately fabricated and then attached to each other using fastening methods, such as but not limited to, welding, bolts, etc. When the hinge arm 110 and the hinge bracket 120 are attached to the shafts 140, the first leg 111a of the first arm section 111 extends through the notch 122 formed in the bracket 120 as noted above and discussed below.

Referring now to FIGS. 7a and 7b, the shafts 140, the arm 110 and the bracket 120 are assembled into the receiving space 102 of housing 101. As explained in detail below, the hinge bracket 120 and the attached hinge arm 110 are together slidable along the shafts 140 within the receiving space 102 of the housing 101.

When assembled, an edge of the first leg 111a of the hinge arm 110 is received within the notch 122 in the bracket 120 such that the hinge arm 110 cannot be rotated within the housing 101. The hinge arm 110 and the bracket 120 are positioned such that the holes 121 in the bracket 120 and the hole 114 in the first leg 111a of the arm 110 are aligned as explained above. Thereafter, the pin 130 is then inserted through the holes 121 and the hole 114.

The bracket 120 and the hinge arm 110 are then inserted into the receiving space 102 of the housing 101 such that the pair holes 123 in the bracket 120 coaxially align with the pairs of holes 108a, 108b in the housing 101. The shafts 140 are inserted into the holes 108b, through the holes 123 in the bracket, through the springs 150 (positioned above the bracket 120) and through the holes 108a.

A clip 131 as noted above is positioned over an upper edge of the second arm section 112 of the hinge arm 110. In particular, the clip 131 is positioned such that holes 132 in the clip 131 align with the hole 117 of the arm 110. A pin 133 is inserted through holes 132 in the clip 131 and through the hole 117 to secure the clip 131 to the arm 110. The clip 131 is pivotable relative the second arm section 112 between a lower position where the upper portion of the clip 131 is flush with the second arm section 112 (see FIG. 7A) and an upper position where the upper portion of the clip 131 is moved away from the second arm section 112 (not shown). For reasons discussed below, the clip 131 is dimensioned to have a width narrower than slots 15c in front bracket 12c but wider than slots 15a, 15b in side members 12a, 12b.

Upon being assembled within the receiving space 102 of housing 101 via hinge shafts 140, the bracket 120 and the arm 110 connected thereto can move vertically within the receiving space 102 along the shafts 140. The springs 150 are positioned between a top surface of the bracket 120 and a lower surface of the upper wall 104a of the housing 101. The springs 150 are dimensioned to bias the bracket 120 and the arm 110 attached thereto to a lower end of the housing 101.

Figure 7C:
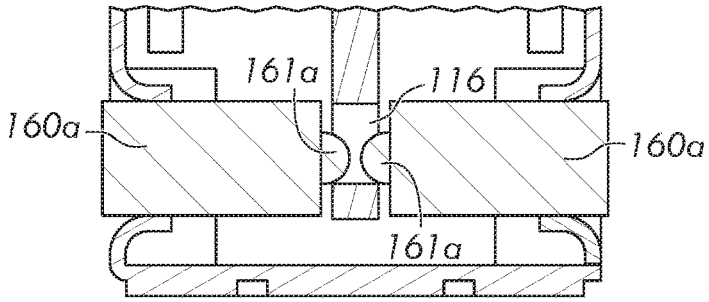
FIG. 7*c* is an enlarged cross-sectional view of a lower portion of the hinge assembly of FIG. 7*a;*

Referring to FIGS. 7*a*-7*c*, upper plungers 160*a* extend through each upper plunger hole 109*a* formed in the upper portion of the housing 101, and lower plungers 160*b* extend through each lower plunger hole 109*b* formed in the lower portion of the housing 101. Each plunger 160*a*, 160*b* includes a rounded, spring-loaded locking element 161*a*, 161*b*. The locking elements 161*a* oppose, and are biased inward toward, one another so as to engage and be received within the hole 115 formed in the first leg 111*a* of the hinge arm 110 when that hole 115 thereof aligns with the locking elements 161*a*. In this manner, the upper plungers 160*a* (via their locking elements 161*a*) are effective to reversibly lock the hinge arm 110 into an upper position in the housing 101. The lower plungers 160*b* are positioned in the lower plungers holes 109*b*, and possess similar locking elements 161*b* as the locking elements 161*a* described above for the upper plungers 160*a*, which are effective to reversibly engage the hole 116 formed in the lower part of the first leg 111*a* of the hinge arm 110 when that hole is aligned therewith, thereby reversibly locking the hinge arm 110 into a lower position in the housing 101.

Returning to FIG. 2*d*, each hinge assembly 100 is attached to an inner surface of the inner panel 4*d* using fasteners (not shown). The hinge assemblies 100 are positioned such that the elongated portion of each second arm section 112 of the hinge arm 110 extends through a corresponding slot 4*e* formed in the inner panel 4*d*. Once the hinge assemblies 100 are attached to the inner surface of inner panel 4*d*, the front panel 4*c* of the door 4 can be attached to the inner panel 4*d* to secure the hinge assemblies 100 within the door 4. The door 4 is attached to the frame 12 by inserting the second arm sections 112 (with the clips 131 rotated to the upper position) through the aligned slots 15*a*, 15*c* or aligned slots 15*b*, 15*c*, respectively of the frame 12. The door 4 is first tilted such that the protrusion 112*b* can be positioned beyond the rods 15*e*. The door 4 is then tilted such that the protrusions 112*b* are positioned behind the rods 12*e* and engage a rear portion of the rods 12*e*. When in the door 4 is in this position, the notches 112*a* in the second arms 112 receive the bottom edges of respective slots 15*a*, 15*b* such that the hinge arms 110 rest on the side members 12*a*, 12*b* of the frame 12. To further assist in securing the door 4 to the frame 12, the clips 131 can be rotated toward the lower position on the second arm sections 112. The clips 131 extend through the slots 15*c* of the front bracket 12*c* and abut against the surface around the outer edges of slots 15*a*, 15*b* such that the arm 110 is fixed relative to the frame 12. The door 4 cannot be removed from the frame 12 until the clips 131 are rotated to their upper positions. Once in the clips 131 are in their upper positions the hinges 110 can be removed from the aligned slots 15*a*, 15*c* or aligned slots 15*b*, 15*c*, respectively in the frame 12. Additionally or alternatively, the elongated portion of each second arm section 112 can be secured to the frame 12 using fasteners, such as bolts, spring clips, etc.

Figure 5A:
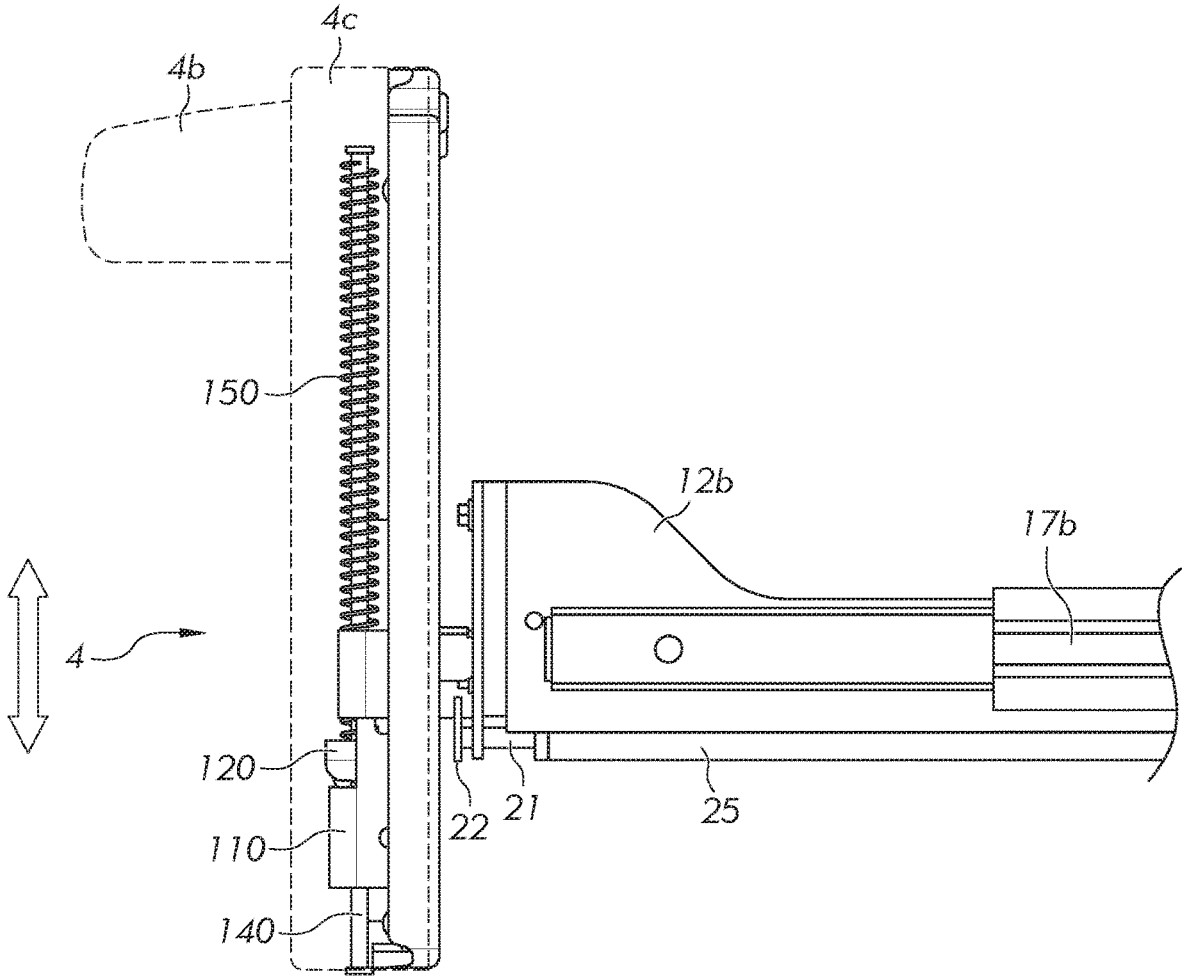
FIG. 5*a* is an enlarged right side view of the rack assembly of FIG. 2*a* showing a hinge assembly according to a first embodiment inside the door and the door in the upper position.
Figure 5B:
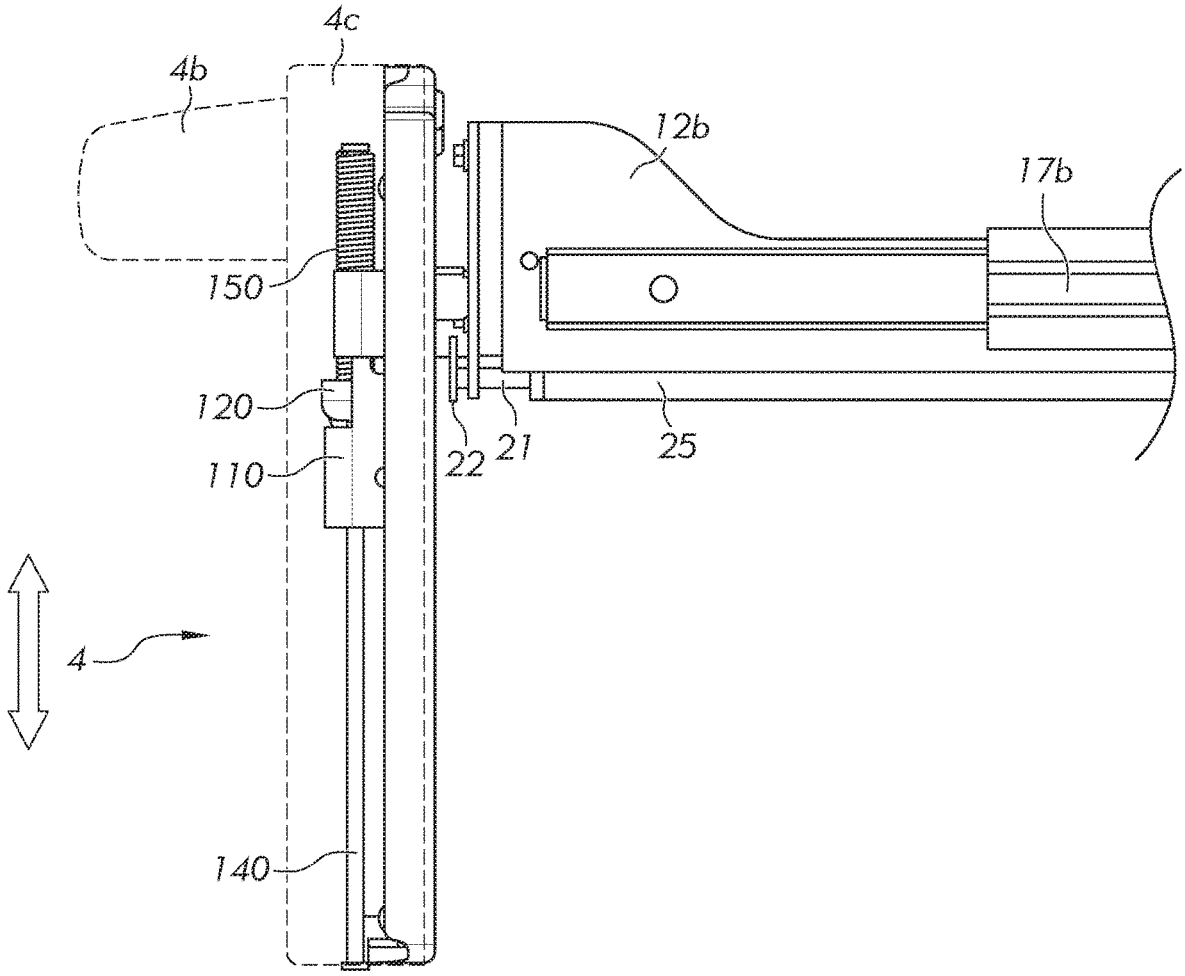
FIG. 5*b* is an enlarged right side view as in FIG. 5*a*, showing the hinge assembly and the door in a lower position.

The hinge assemblies 100 are connected to the rack assembly 10 such that movement of the arm 110 with respect to the housing 101 of the hinge assembly 100 allows the door 4 to slide vertically with respect to the rack assembly 10. Specifically, the door 4 can be slid between an upper position (also referred to as a "first" position) (see FIG. 5*a*) and a lower position (also referred to as a "second" position) (see FIG. 5*b*). When the door 4 is slid from the upper position to the lower position, the hinge bracket 120 and the hinge arm 110 move upward with respect to the housing 101 (because they are vertically fixed with respect to the rack assembly 10, whereas the housing is vertically fixed with respect to the door 4), from a first end of the housing 101 to a second end of the housing 101. As noted above, the springs 150 bias the hinge bracket 120 and the hinge arm 110 into the first end (lower position) within the housing 101 such that the door 4 is biased into the upper (normally closed) position. To secure the hinge bracket 120 and the hinge arm 110 into the lower position (and the door in the upper position), the lower plungers 160*b* engage the holes 116 in the arm 110 (see FIG. 7*c*). To unlock the door 4 and move the door 4 to the lower position, the user exerts a downward force on the door 4 that overcomes the spring force of the locking elements 161*b* of the lower plungers 160*b* to force the locking elements 161*b* laterally outward, out of engagement with the associate hole 116 in the first leg 111*a* of the hinge arm 110. The user continues to apply a downward force to the door 4 to compress the springs 150 and move the bracket 120 to the upper portion of the housing 101. Once the door 4 reaches the lower position the upper plungers 160*a* engage the holes 115 in the first leg 111*a* of the hinge arm 110, thereby locking the door 4 in the lower position. The user may return the door 4 to the upper position by applying a lifting force to the door 4 to overcome the spring force of the upper plungers 160*a*, thereby disengaging the associated locking elements 161*a* from the respective holes 115. The door 4 may continue to slide until the lower plungers 160*b* engage the holes 116 in the first leg 111*a* of the hinge arm 110 to lock the door in the upper position.

As described in detail above, the user may move the door 4 between the upper position and the lower position while the rack assembly 10 is in the extended position. To prevent the rack assembly 10 from moving to the retracted position while the door 4 is in the lower position, the rack assembly 10 may further include lock assemblies 20 that lock the rack assembly 10 into the extended position.

Figure 8:
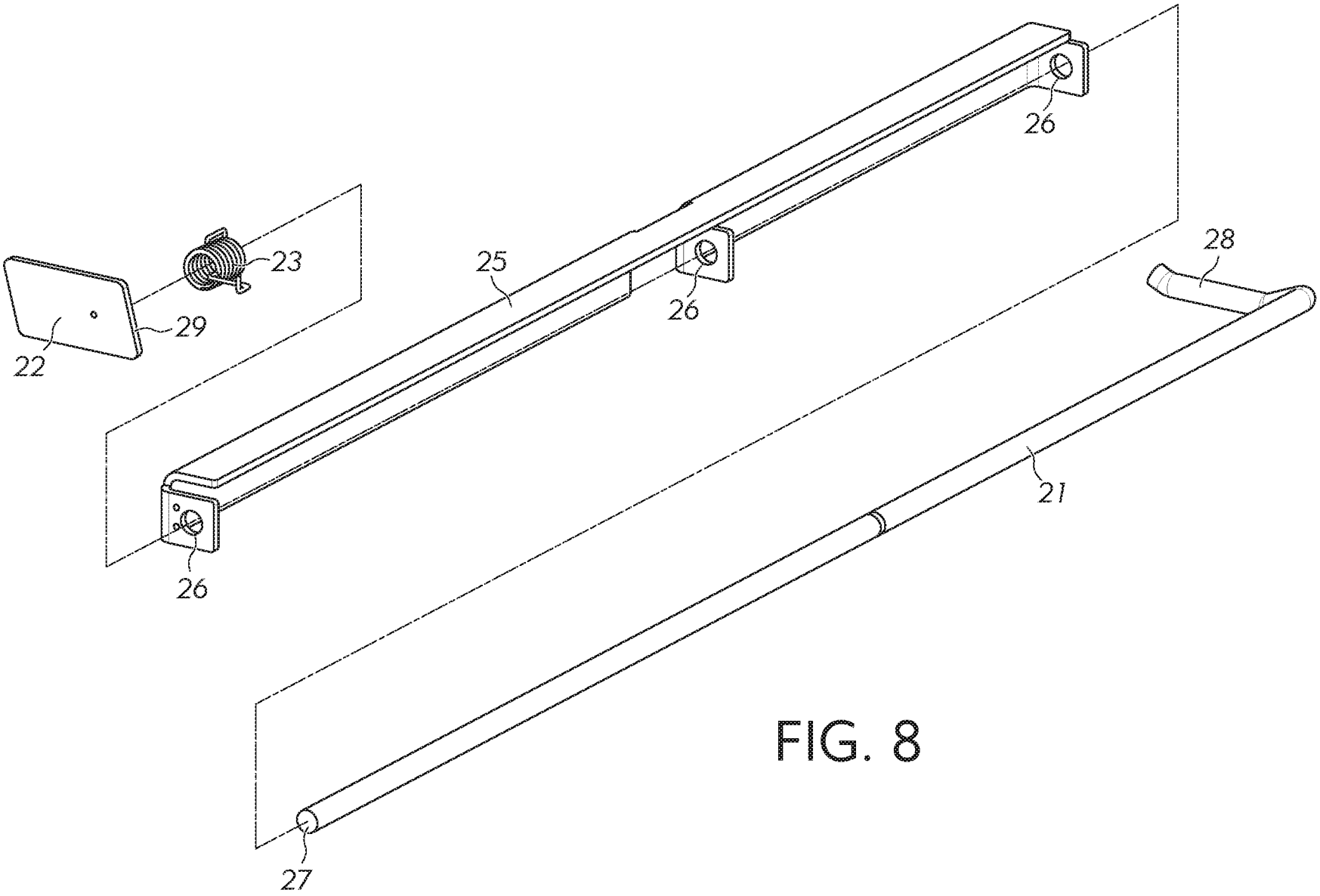
FIG. 8 is an exploded view of a locking assembly according to a first embodiment.
Figure 10A:
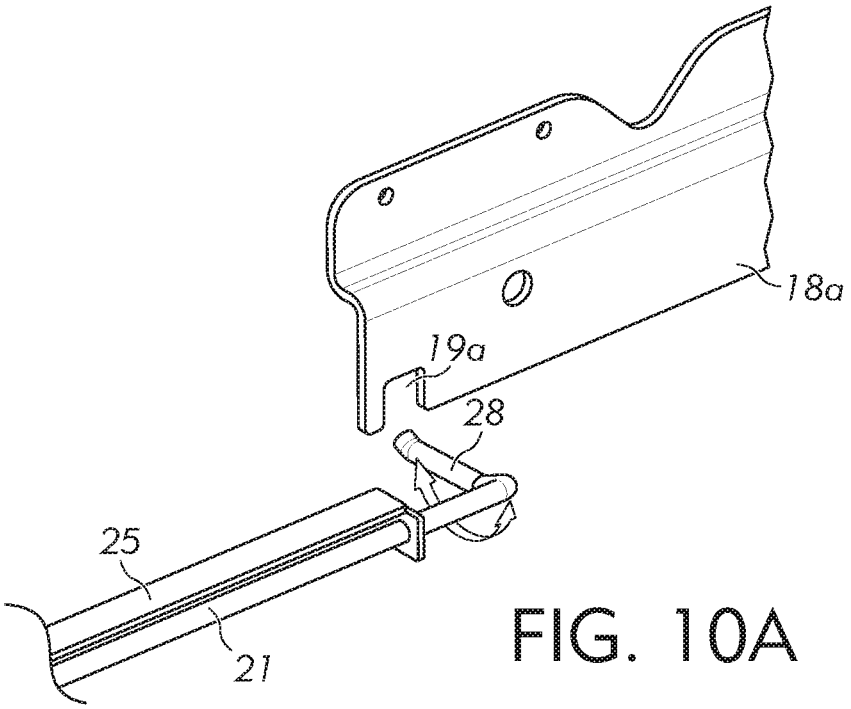
FIG. 10*a* is an enlarged perspective view of a bent end of the locking assembly of FIG. 8 in an unlocked position.
Figure 10B:
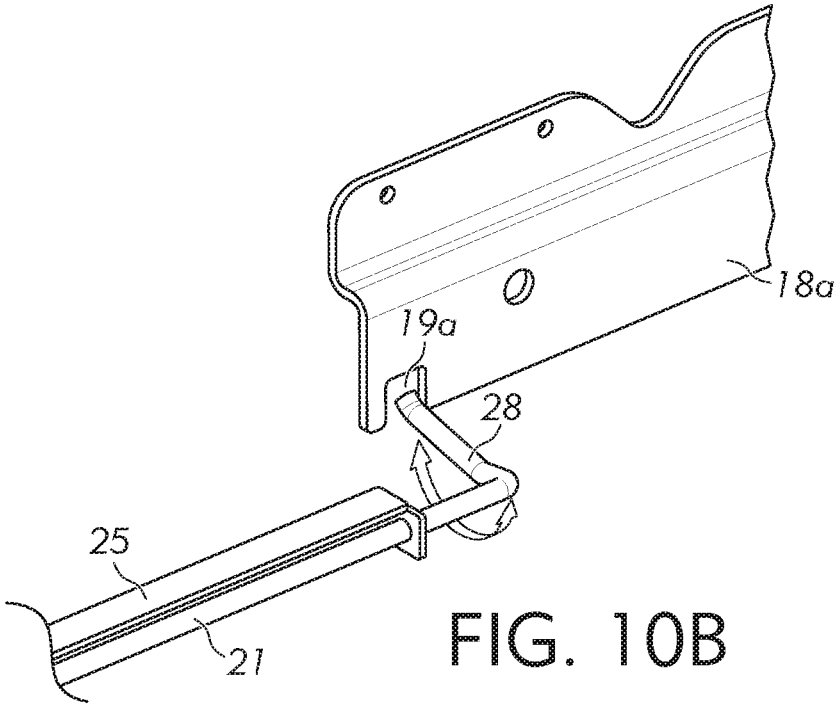
FIG. 10*b* is an enlarged perspective view of the bent end of the locking assembly of FIG. 8 rotated to a locked position.

In general, each lock assembly 20 (shown in FIG. 8) includes a bar 21, a tab element 22 and a spring 23. The bar 21 is an elongated element having a first end 27 positioned adjacent the inner panel 4*d* of the door 4 and a second, oppositely disposed bent end 28. Respective notches 19*a* and 19*b* are formed at the forward ends of the respective cavity brackets 18*a* and 18*b*, which are dimensioned to receive therein the respective bent ends 28 of the locking bars 21 when rotated into a locked position as will be more fully described. Alternatively, the notches 19*a* and 19*b* may be formed in the fixed arms 16*a*, 16*b* of the slide assemblies 13*a*, 13*b* or even directly in the side walls 3*a* of the oven cavity. The tab element 22 is attached to the first end 27 of the bar 21. As shown, the second, bent end 28 extends at an angle (e.g. generally perpendicular relative to) the longitudinal extent of the bar 21. The bar 21 extends through holes 26 formed in a bracket 25 that is attached to the frame 12 so that the bar 21 can rotate relative to the bracket 25. When the bar 21 rotates while the rack assembly 10 is in the extended, fully withdrawn position, the bent second end 28 of the bar 21 is aligned with the associated notch 19*a*, 19*b* such that rotation thereof will cause the bend end 28 to engage within the notch 19*a*, 19*b*. The spring 23 is disposed around the bar 21 and preferably is a torsion spring effective to bias the bent end 28 of the bar 21 out of engagement with the notch 19*a*, 19*b* (see FIGS. 10*a*-10*b*). It is contemplated that the spring 23 could be another type of biasing element, e.g., a compression spring, so long as it is configured to bias the bar 21 into the unlocked position.

Figure 9B:
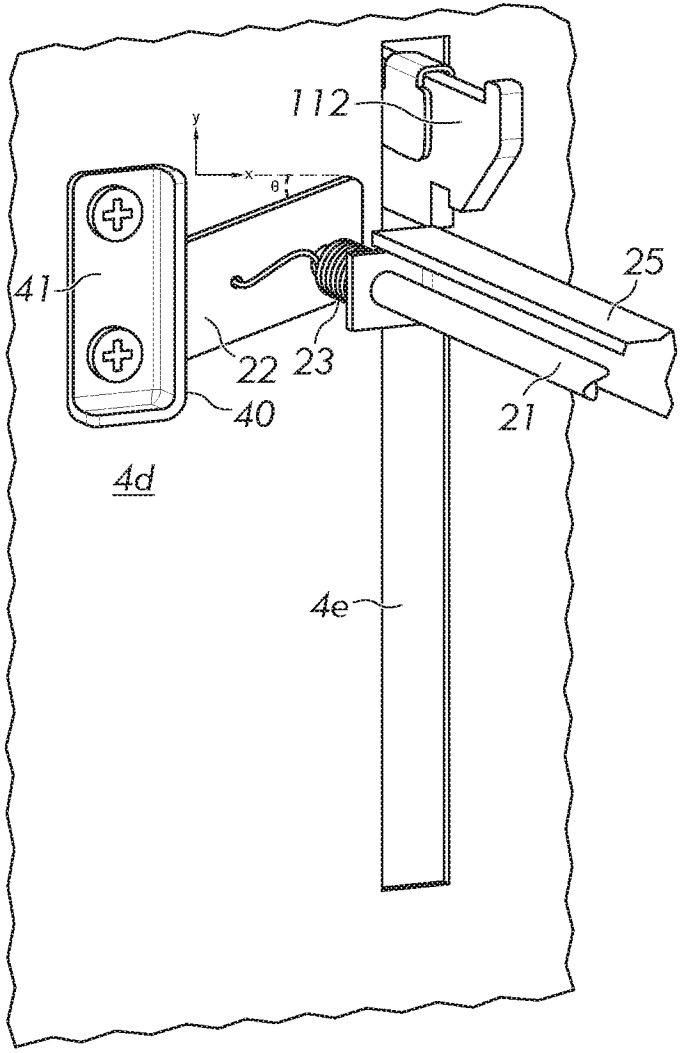
FIG. 9*b* is a perspective view of the locking assembly of FIG. 8 showing the locking assembly in a locked position.
Figure 9A:
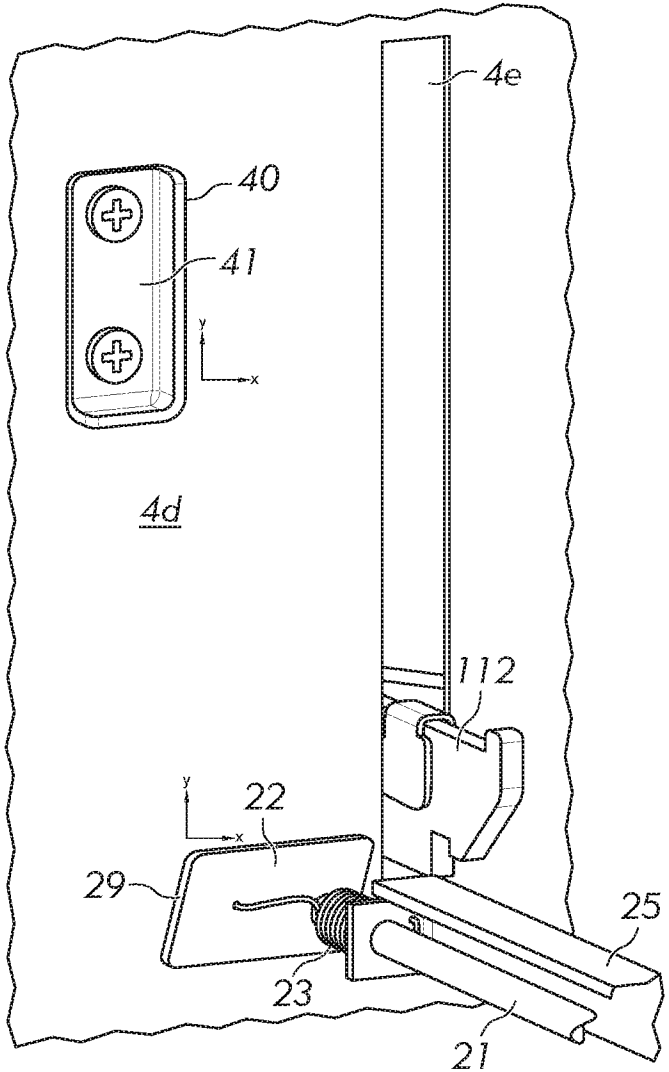
FIG. 9*a* is a perspective view of an end of the locking assembly of FIG. 8 adjacent the door of FIG. 4 showing the locking assembly in an unlocked position.

Referring to FIGS. 9*a* and 9*b*, the inner panel 4*d* of the door 4 includes a bracket 40 designed to interact with the tab element 22 of the associated lock assembly 20. Specifically, when the door 4 is slid from the upper position (FIG. 9*a*) to the lower position (FIG. 9*b*), the door brackets 40 interact with the tab elements 22. In particular, the brackets 40 and the tab elements 22 are positioned to interact with each other such that as the door moves from the upper position to the lower position the door brackets 40 cause the bars 21 to rotate by displacing the attached tab elements 22. This rotation in-turn drives the opposite, bent ends 28 of the respective bars 21 into locking engagement with the associated notches 19*a* and 19*b* (see FIG. 10*b*), thereby inhibiting closing the door 4 (and retraction of the rack assembly 10) while the door is in its lower position. Particularly, in the illustrated embodiment the bracket 40 has a pushing edge 41 that engages a pushable edge 29 of the tab element to rotate the tab element 22 by an angle θ (see also reference axes in FIGS. 9A and 9B to show relative positions of tab element 22 and bracket 40), thereby causing the attached bar 21 to rotate when the pushing edge 41 engages the pushable edge 29.

Accordingly, when the door 4 is slid downwards to the lower position, the locking assembly 20 locks the rack assembly 10 in the extended position. This allows a user to place a food item on to or take a food item off of the cooking rack 11 without risk that (s)he will accidentally push the rack assembly 10 inward, into the oven cavity, which would increase the risk of being burned. When the door 4 is lifted to the upper position, the bent end of the locking assembly 20 rotates out of the notch 19*a*, 19*b* (see FIG. 10*a*) so that the rack assembly 10 may be slid back into the oven cavity 3. As will be appreciated, respective left- and right-locking assemblies 20 may be provided and associated with each of the left- and right hinge assemblies 100 of the door 4, in order that retraction of the rack assembly 10 will be inhibited from both the left and right sides when the door 4 is in the lower position.

Figure 12:
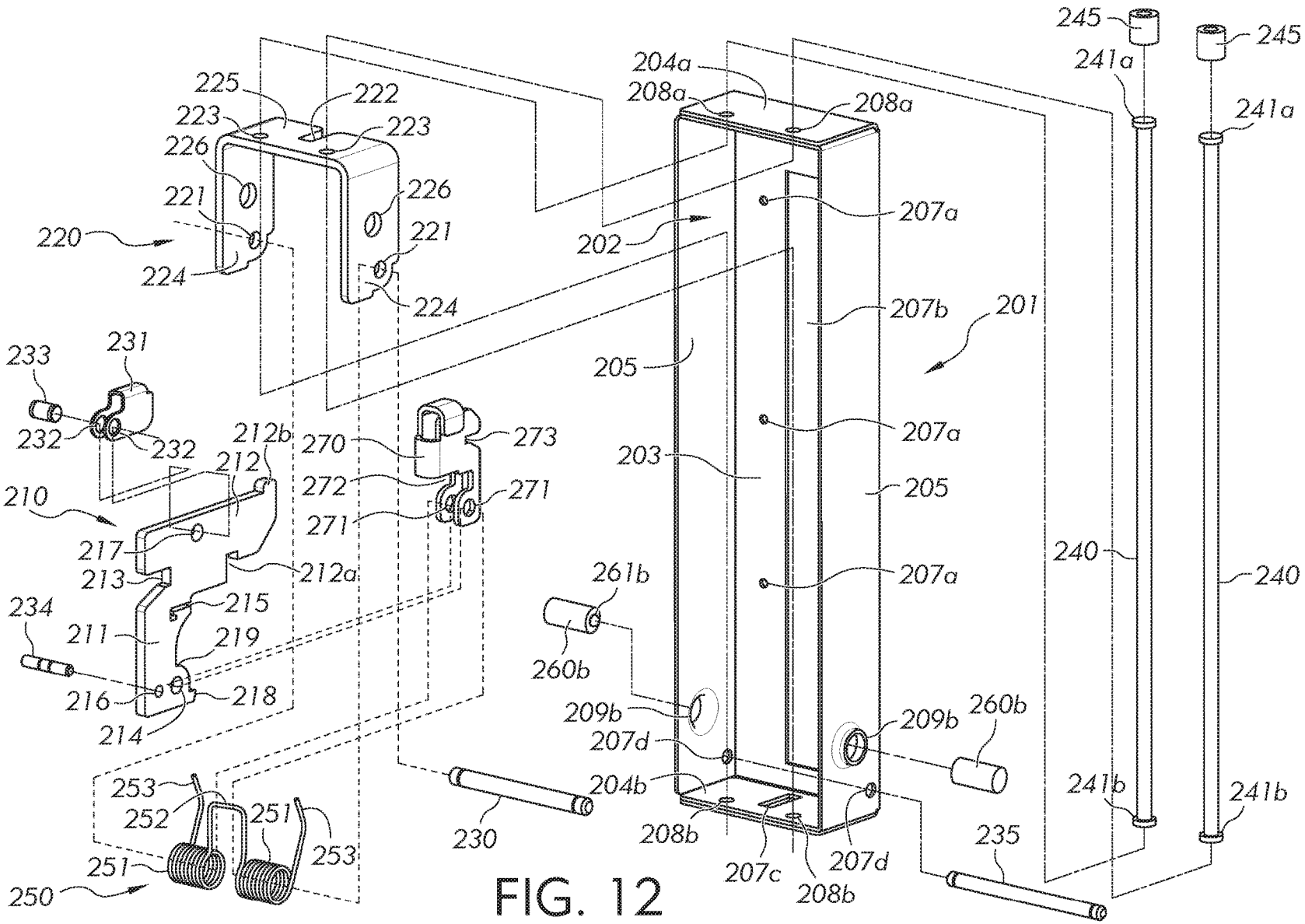
FIG. 12 is an exploded view of the hinge assembly shown in FIG. 11*a;*

According to a second embodiment, the door 4 can include two hinge assemblies 200 having an alternative configuration, an exploded view of one of which is depicted in FIG. 12. Like the hinge assembly 100, the hinge assembly 200 includes a housing 201, a pair of shafts 240, a hinge bracket 220, and a hinge arm 210. Only one hinge assembly 200 is described below. The other hinge assembly applicable to the opposite (left or right) side of the door in this embodiment will be identical. That is, the hinge assembly 200 according to this embodiment is an ambidextrous part.

Referring to FIG. 12, the housing 201 includes a rear wall 203, a top wall 204*a*, a bottom wall 204*b*, and side walls 205 that together define a receiving space 202 for housing the other components of the hinge assembly 200. The rear wall 203 may include mounting holes 207*a* that are dimensioned to receive fasteners (not shown) so that the housing 201 can be affixed to the inner panel 4*d* of the door 4 (similar to FIG. 4).

A slot 207*b* extends vertically through the rear wall 203 from an upper end of the housing 201 to a lower end of the housing 201. The slot 207*b* is dimensioned to allow a portion of the hinge arm 210 to extend therethrough, as described in detail below. A lower slot 207*c* extends through the bottom wall 204*b* for allowing a portion of the hinge arm 210 to extend therethrough, as described in detail below.

A pair of upper shaft holes 208*a* extend through the top wall 204*a* of the housing 201 and a pair of lower shaft holes 208*b* extend through the bottom wall 204*b* of the housing 201. The shaft holes 208*a*, 208*b* are positioned and dimensioned as described in detail below.

A through hole 209*b* extends through a lower portion of each side wall 205 of the housing 201. The through holes 209*b* are dimensioned and positioned two receive plunger elements 260*b*, as described in detail below. A hole 207*d* extends through a lower portion of each side wall 205 of the housing 201. The holes 207*d* are dimensioned and positioned to receive a support pin 235, as described in detail below.

The shafts 240 include upper ends that extend respectively through one of the upper shaft holes 208*a*, and a lower ends that extend respectively through one of the lower shaft hole 208*b*. As shown, the shafts 240 are elongated, rod-shaped elements having a knob 241 at either end. The shafts 240 are dimensioned such that at least one of the knobs 241 is removable to allow the shaft 240 to extend through the holes 208*a*, 208*b*. The knob 241 may then be reattached to secure the shaft 240 to the housing 101 (see FIGS. 13*a* and 13*b*). It is also contemplated that the shafts 240 could be secured to the housing 201 using other methods, such as, but not limited to, threads, welding, adhesives, nuts, etc.

The hinge bracket 220 is a generally U-shaped component having opposing legs 224 extending from a base portion 225. A pivot hole 221 and a through hole 226 extend through each leg 224. The pivot holes 221 in each leg are dimensioned and positioned to align with each other and define a pivot axis of the hinge assembly 200, as described in detail below. The through holes 226 are dimensioned and positioned to receive distal ends of plunger elements 260*b*, as described in detail below. Two holes 223 extend through the base portion 225 for slidably receiving the shafts 240. A notch 222 is formed in an edge of the bracket 220 for slidably receiving a notch 213 of the hinge arm 210 as discussed in detail below.

The hinge arm 210 is a generally L-shaped element having a first section 211 and a second section 212. A pivot hole 214 extends through the first section 211 and is dimensioned and positioned to align with the pivot holes 221 extending through the legs 224 of the bracket 220. The pivot holes 221 in the bracket 220 and the pivot hole 214 in the first section 211 are dimensioned and positioned to allow a pivot pin 230 to extend therethrough to secure the hinge bracket 220 and the hinge arm 210 together and allow the bracket 220 and the housing 201 to pivot relative to the arm 210.

Another hole 216 extends through the first section 211 of the hinge arm 210. The second hole 216 is dimensioned and positioned to receive a pin 234 therethrough. Another hole 217 extends through the second section 212 of the hinge arm 210 for receiving a pin 233 that attaches a clip 231 having holes 232 to the second section 212 of the hinge arm 210. The clip 231 is similar to the clip 131 in the embodiment discussed above. Specifically, the clip 231 is pivotable between an upper position and a lower position relative to the arm section 212 and is dimensioned to have a width narrower than slots 15*c* in front bracket 12*c* but narrower than slots 15*a*, 15*b* in side members 12*a*, 12*b*. The second arm section 212 also includes a notch 212*a* formed in a lower edge and a protrusion 212*b* extending upward from an upper edge of the second arm section 212 (see FIG. 12).

The first notch 213 is formed and extends inward from an outer edge of the first arm section 211. The first notch 213 is dimensioned and position to complementarily receive the notch 222 of the hinge bracket 220 when the hinge arm 210 and the hinge bracket 220 are attached to each other. A second notch 215 is formed and extends outward from the opposite, inner edge 219 of the first arm section 211 of the hinge arm 210, for receiving a portion of a spring 250, as described in detail below. The bottom of the first arm section 211 may include a tab 218 that is dimensioned and positioned as described in detail below.

The second section 212 of the hinge arm 210 includes an elongated portion that is dimensioned to extend through the slot 207*b* in the rear wall 203 of the housing 201, as well as one of the slots 4*e* in the inner panel 4*d* of the door 4, for securing the door 4 to the frame 12 as discussed in greater detail below, when the hinge assembly 200 is secured to the inner panel 4*d* of the door 4.

A spring 250 is provided and includes two wound sections 251 on opposing left and right sides of an intermediate spring arm 252, and two distal arms 253 extending from the lateral-most portions of the opposing wound sections. As shown, the wound sections 251 are generally cylindrical in shape and share a common axis. The intermediate arm 252 extends between the inner ends of the wound sections 251. As shown, the intermediate arm 252 is generally U-shaped. The distal arms 253 extend from outer ends of the respective wound sections 251.

A limit bracket 270 is positioned on the hinge arm 210. As shown, the limit bracket 270 is a generally U-shaped element having a first leg and a second leg. Holes 271 extend through both the first leg and the second leg and are axially aligned. Notches 272, 273 are formed on opposite front and rear sides of the limit bracket 270. The notches 272, 273 are positioned and dimensioned as described in detail below.

Figure 13A:
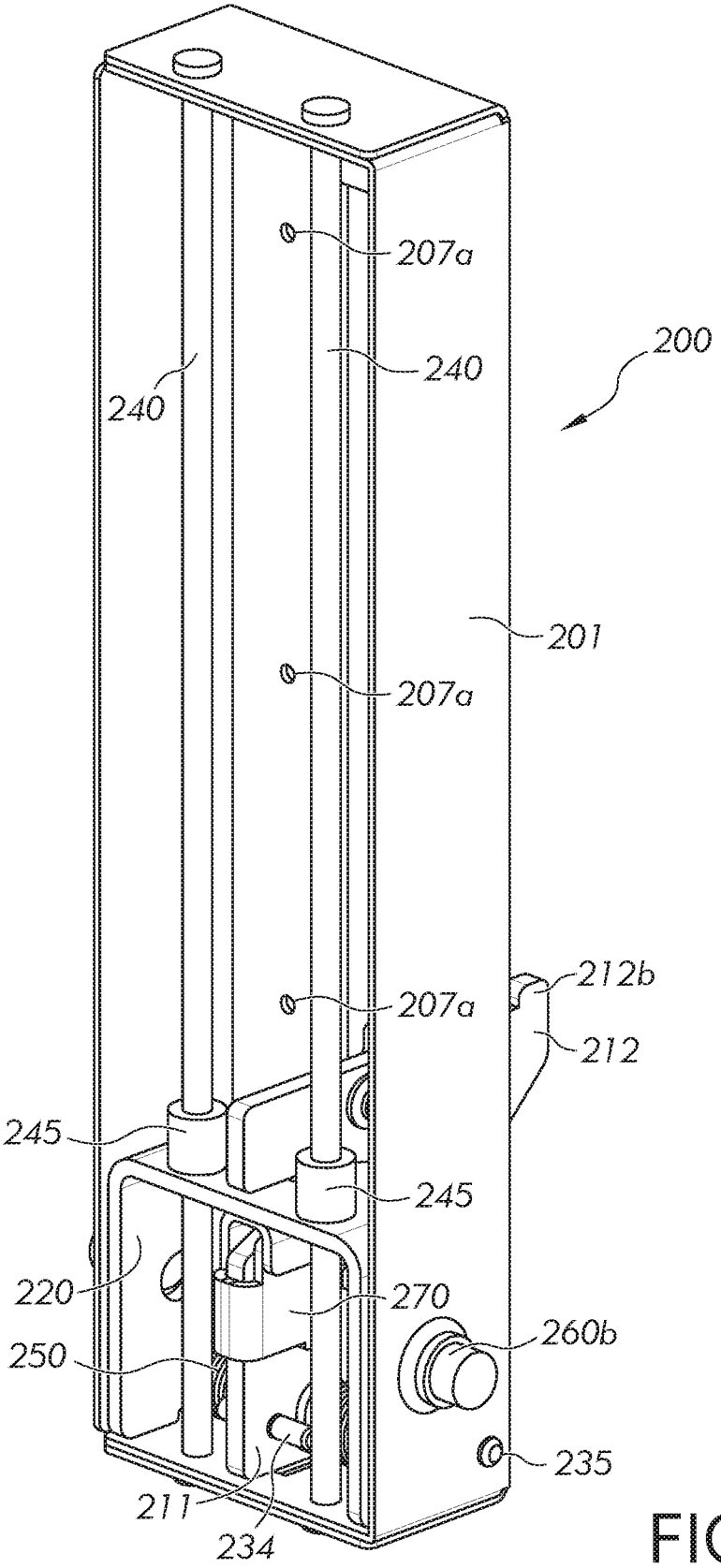
FIG. 13*a* is a front perspective view of the hinge assembly of FIG. 12.
Figure 13B:
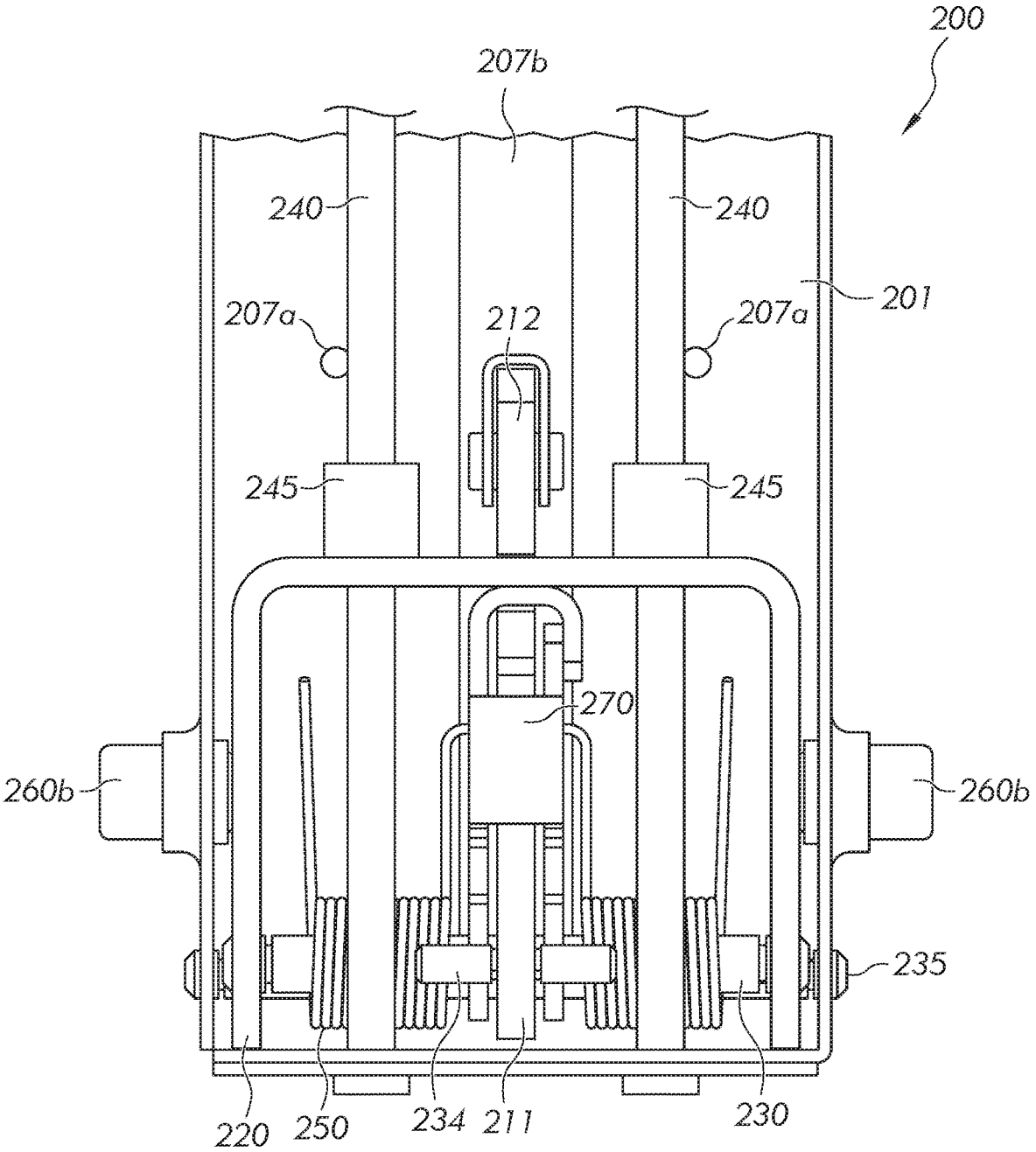
FIG. 13*b* is a front view of a lower portion of the hinge assembly of FIG. 13*a;*
Figure 13C:
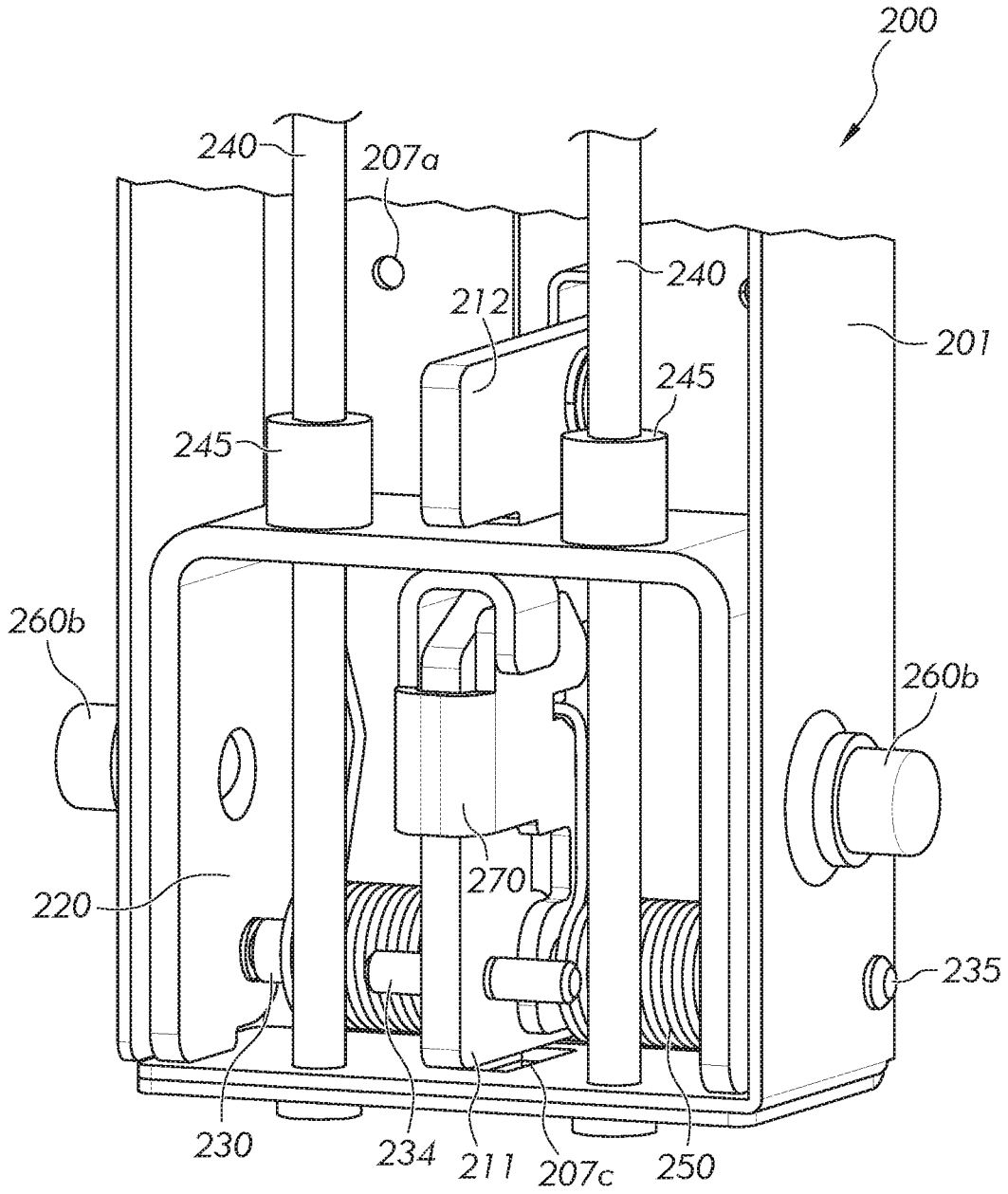
FIG. 13*c* is a front perspective view of the lower portion of the hinge assembly of FIG. 13*a* showing the door in a vertical position.

Referring now to FIGS. 13*a*-13*c* the shafts 240, the hinge arm 210, the hinge bracket 220 and the limit bracket 270 are assembled into the receiving space 202 of housing 201. As explained in detail below, the hinge bracket 220 and the hinge arm 210 are configured to slide along the shafts 240 within the receiving space 202 of the housing 201. The housing 201 and the hinge bracket 220 are also configured to pivot relative to the arm 210 about pin 230.

The hinge arm 210 is positioned on the hinge bracket 220 such that the first notch 213 on the hinge arm 210 mates with the complementary notch 222 provided in the hinge bracket 220. The spring 250 is positioned inside the bracket 220 such that wound sections 251 of the spring 250 are placed on opposite sides of the hinge arm 210, and the intermediate spring arm 252 of the spring 250 is inserted into the second notch 215 of the hinge arm 210. The limit bracket 270 is positioned at a front edge of the arm 252 (adjacent to the hinge arm 210) such that the holes 271 in the limit bracket 270 align with the hole 214 in the hinge arm 210. The notch 273 on one side of the limit bracket 270 aligns with the notch 215 in the hinge arm 210. The hinge arm 210 and the spring 250 are positioned such that the holes 221 in the hinge bracket 220 and the hole 214 of the hinge arm 210 align with the openings of the wound sections 251. Thereafter, the pivot pin 230 is inserted through the hole 221 in the bracket 220, through one wound section 251 of the spring 250, through one hole 271 of the limit bracket 270, through the hinge arm 210, through the other hole 271 of the limit bracket 270, through the other wound section 251 and into the hole 221 in the bracket 220. As explained in detail below, the pivot pin 230 defines a pivot axis of the hinge assembly 200.

The hinge bracket 220 and the hinge arm 210 are then inserted into the receiving space 202 of the housing 201 such that the holes 223 in the bracket align with the holes 208*a*, 208*b* in the housing 201. The shafts 240 are inserted into the holes 208*b* from beneath the housing 201, through the holes 223 in the hinge bracket 220, through bushings 245 (positioned above the bracket 220) and through the holes 208*a*, 208*b* at the top of the housing 201. The spring 250 has two bent arms 253 that rest against the rear wall 203 of the housing 201 upon the assembly of the hinge arm 210, hinge bracket 220, and spring 250 within the receiving space 202 of the housing 201. The spring 250 is configured to bias the bracket 220 and the housing 201 to position the door 4 in a closed position, as described in detail below.

A clip 231 is positioned over an upper edge of the hinge arm 210. In particular, the clip 231 is positioned such that holes 232 in the clip 231 align with the hole 217 in the second section 212 of the hinge arm 210. A pin 233 is inserted through holes 232 in the clip 231 and through the hole 217 to secure the clip 231 to the hinge arm 210.

A first stop pin 234 is inserted into the hole 216 in the hinge arm 210. The stop pin 234 is positioned and dimensioned to limit the rotation of the hinge bracket 220 and the housing 201, as described in detail below. A second stop pin 235 is inserted into the holes 207*d* in the lower portion of the housing 201. The second stop pin 235 is positioned and dimensioned to limit the translation of the bracket 220 relative to the housing 201, as described in detail below.

Plungers 260*b* are positioned into plunger holes 209*b* formed in the lower portion or a first end of the housing 201. Each plunger 260*b* includes a rounded, spring-loaded locking element 261*b*. The plungers 260*b* are positioned in the plungers holes 209*b* for engaging the second holes 226 formed in the legs 224 of the hinge bracket 220 when the holes 226 in the bracket 220 align with the respective plungers 260*b*. The plungers 260*b* are effective to lock the hinge bracket 220 into a lower position in the housing 201 and thus serve as locking elements (see FIGS. 13*a*-13*c*), similarly as plungers 160*a*, 160*b* and locking elements 161*a*, 161*b* as described for the preceding embodiment of the hinge assembly 100.

Similar to the preceding embodiment as illustrated in FIGS. 2*d* and 4, each hinge assembly 200 is attached to an inner surface of the inner panel 4*d* using fasteners (not shown). As mentioned above, the hinge assemblies 200 are positioned such that elongated portions 212 of each second arm 212 extends through corresponding slots 4*e* formed in the inner panel 4*d*. Once the hinge assemblies 200 are attached to the inner surface of inner panel 4*d*, the front panel 4*c* of the door 4 can be attached to the inner panel 4*d* to secure the hinge assemblies 200 within the door 4. The door 4 is attached to the frame 12 via the hinge assemblies 200 similar to the first embodiment discussed above. Specifically, the door 4 is tilted and the second arm sections 212 (with the clips in their upper positions) are inserted through the aligned slots 15*a*, 15*c* or the aligned slots 15*b*, 15*c*, respectively in the frame 12. The door 4 is then tilted back such that protrusions 212*b* are positioned behind rods 15*e* and engage a rear portion of the rods 15*e*. In this position, the notches 212*a* rest on the bottom edges of slots 15*a*, 15*b*. The clips 231 can then be rotated toward their lower positions such that they abut against the surface around the outer edges of the slots 15*a*, 15*b* in the side members 12*a*, 12*b* (see FIG. 14A). The door 4 cannot be removed from the frame 12 until the clips 231 are rotated to their upper positions. Once the clips 231 are in their upper positions the hinges 110 can be removed from the aligned slots 15*a*, 15*c* or aligned slots 15*b*, 15*c*, respectively in the frame 12. Additionally or alternatively, the elongated portion of each second arm 212 can be secured to the frame 12 using fasteners, such as bolts, spring clips, etc.

Figure 11A:
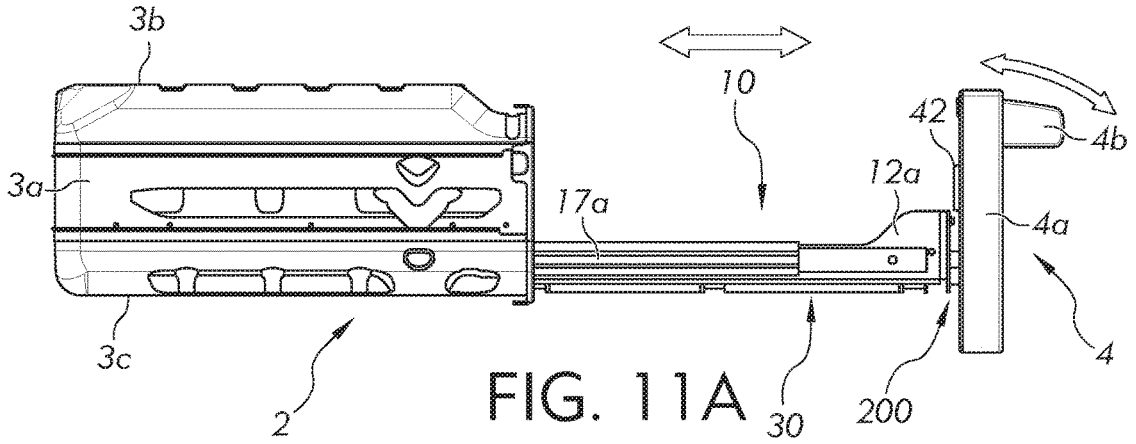
FIG. 11*a* is a left side view of the upper oven of FIG. 1 having a hinge assembly according to a second embodiment, showing a rack assembly in an extended position and a door of the rack assembly in a vertical position.
Figure 11B:
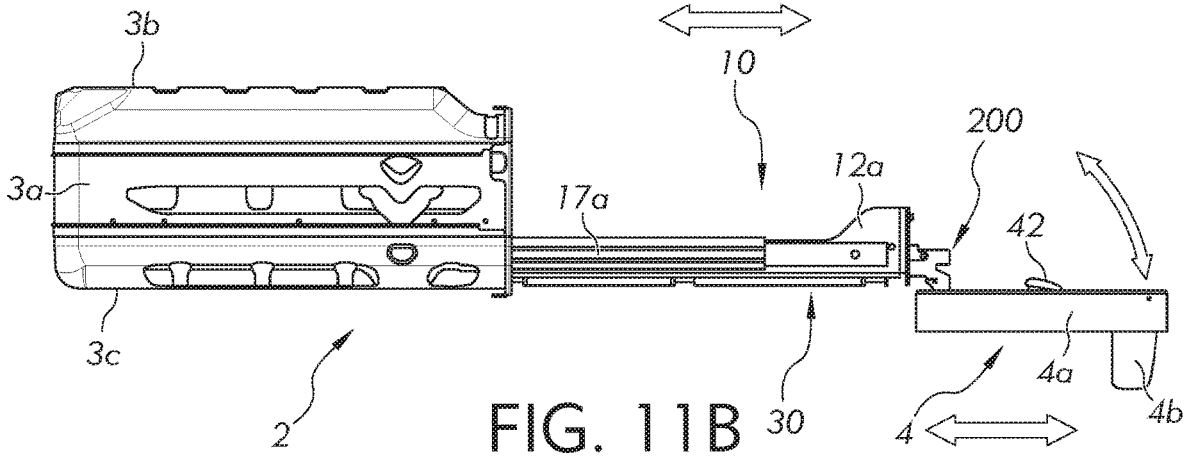
FIG. 11*b* is a left side view of the upper oven FIG. 11*a*, showing the door in a first horizontal position.

The hinge assemblies 200 are connected to the rack assembly 10 such that pivoting of the hinge bracket 220 and the housing 201 of the hinge assembly 200 relative to the hinge arm 210 causes the door 4 to pivot with respect to the rack assembly 10. Specifically, the door 4 can be pivoted between a vertical, closed position (see FIG. 11*a*) and a first horizontal, open position (also referred to as a "first" position) (see FIG. 11*b*). As noted above, the spring 250 biases the housing 201 and the bracket 220 in order that the door would be biased to its closed position as seen in FIG. 11*a*. When the door 4 is pivoted from the closed (vertical) position to the first horizontal position, the hinge bracket 220 and the housing 201 (with the door 4) pivot about the pivot pin 230 (see FIG. 14*a*). In this respect, the pivot pin 230 defines a pivot axis of the door 4.

Figure 14A:
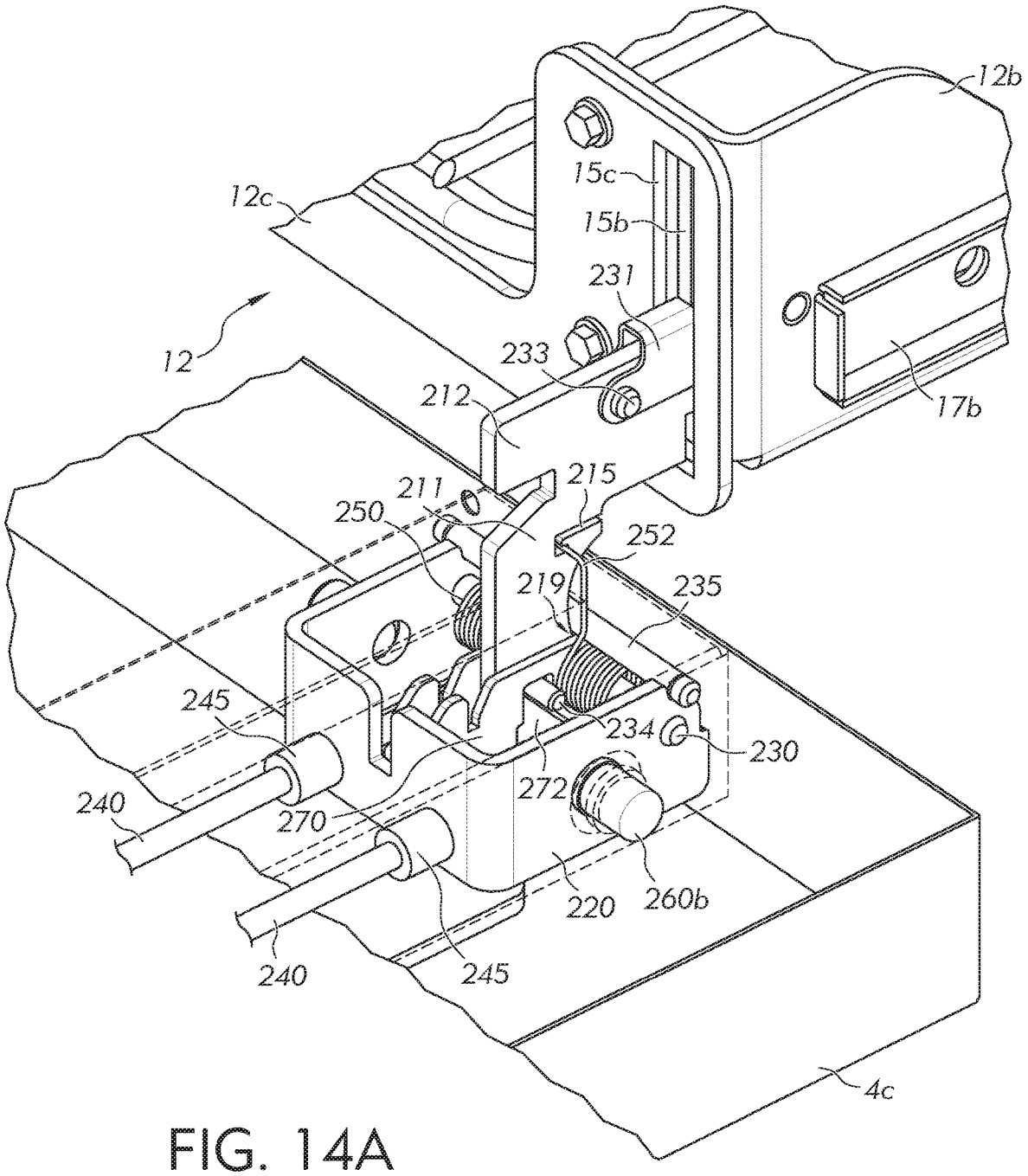
FIG. 14*a* is a front perspective view of the lower portion of the hinge assembly of FIG. 13*a* showing the door in the first horizontal position.

The limit bracket 270 is provided to prevent the door 4 from pivoting past the first horizontal position. Referring to FIG. 14*a*, the notch 272 in the limit bracket 270 is dimensioned and positioned to engage the first stop pin 234 when the door 4 is in the first horizontal position such that the first stop pin 234 prevents the door 4 from rotating further.

Figure 15:
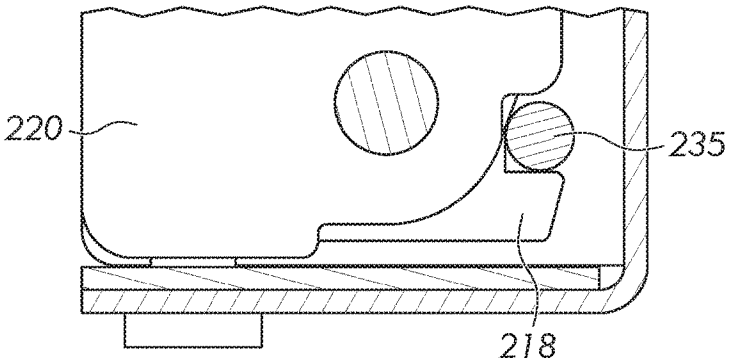
FIG. 15 is a right side view of a lower portion of the hinge assembly of FIG. 13*a;*

Referring to FIG. 15, the tab 218 formed in the lower edge of the hinge arm 210 facing the housing 201 defines a "stop" for limiting the rotation of the housing 201 relative to the arm 210. When the housing 201 and the hinge bracket 220 rotate between the vertical orientation (FIG. 13*a*) and the first horizontal orientation (FIG. 14*a*), the second stop pin 235 moves along the curved portion of the first arm section 211 between the lower edge 219 (see FIG. 14*a*) and the tab 218 (see FIG. 15). The lower edge 219 and tab 218 serve as stops for limiting the rotation of the housing 201 via the stop pin 235 with respect to the arm 210.

Figure 11C:
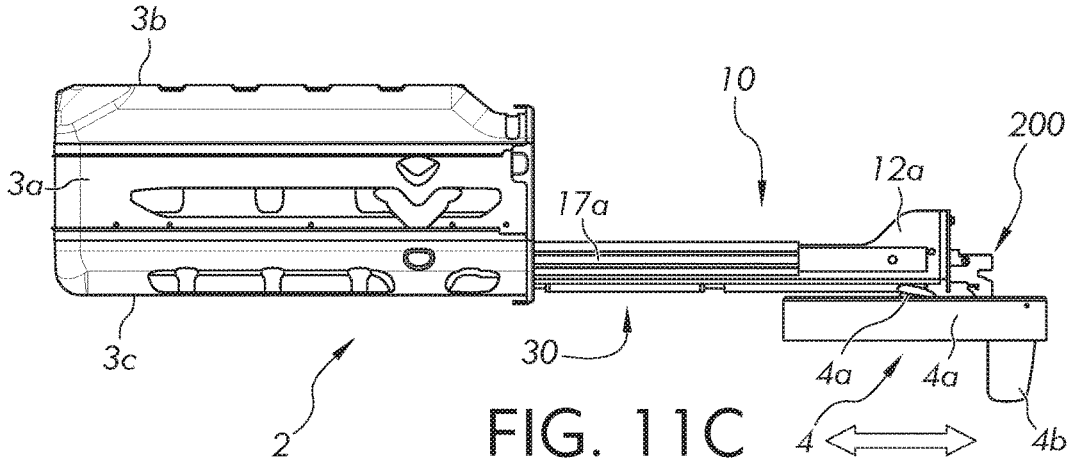
FIG. 11*c* is a left side view of the upper oven of FIG. 11*a*, showing the door in a second horizontal (stowed) position.
Figure 11D:
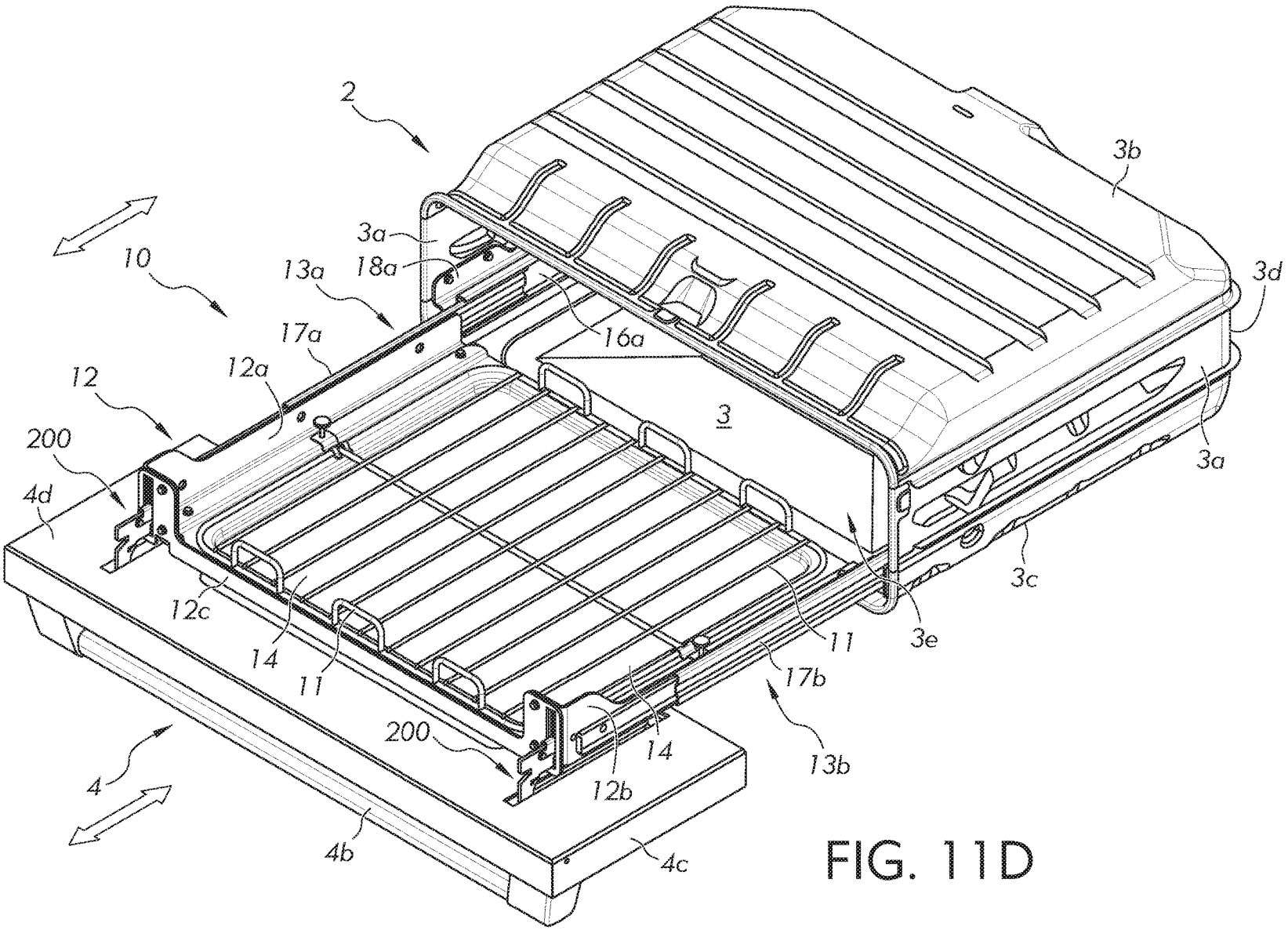
FIG. 11*d* is a front perspective view of the upper oven of FIG. 11*c;*

Referring to FIG. 13*c*, as noted above, the notch 213 on the hinge arm 210 is dimensioned and positioned to complementarily engage the notch 222 in the bracket 220. As such, when the door 4 is in the vertical position the hinge arm 210 prevents the bracket 220 from sliding within the housing 201. When the door 4 is pivoted from the vertical position to the first horizontal position (FIG. 14*a*) the hinge bracket 220 is moved out of engagement with the hinge arm 210. The bracket 220 is then free to slide relative to the housing 201. Once in the first horizontal position, the door 4 can be slid from the first horizontal position proximate a front edge of the frame 12 to a second horizontal position (also referred to as a "second" position or a stowed position) (see FIGS. 11*c* and 11*d*) that is at least partially underneath the rack assembly 10.

Figure 14B:
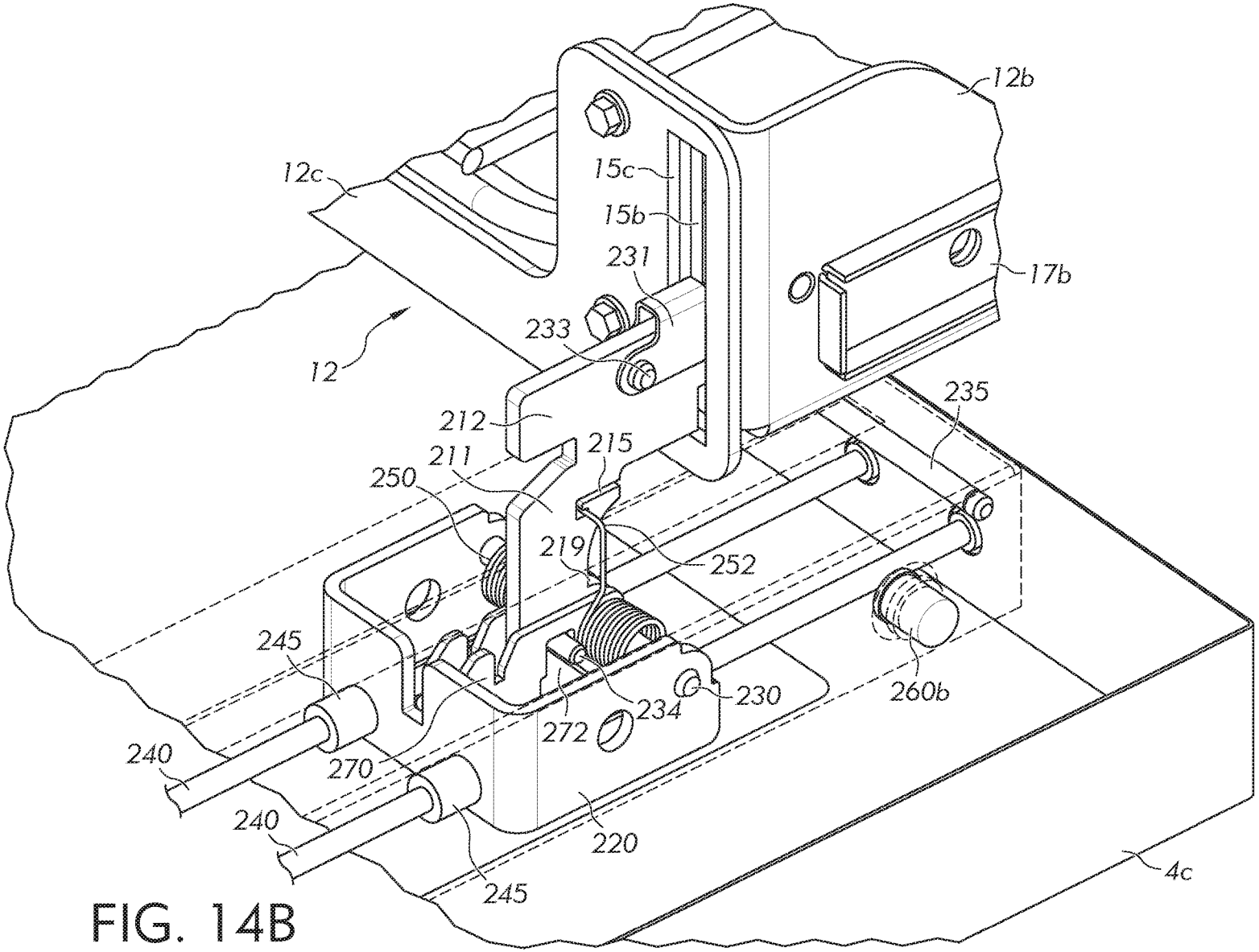
FIG. 14*b* is a front perspective view of the lower portion of the hinge assembly of FIG. 13*a* showing the door between the first horizontal position and a second (stowed) horizontal position.

When the door 4 is slid from the first horizontal position to the second horizontal (stowed) position, the housing 201 (and the door 4) slides relative to the bracket 220 (which cannot translate relative to the hinge arm 210) (see FIG. 14*b*). In particular, as the housing 201 slides, the shafts 240 slide through the bracket 220 allowing the bracket 220 to translate within the receiving space 202 from proximate the lower wall 204*b* of the housing 201, i.e., the first end of the housing 201, toward the upper wall 204*a* of the housing 201, i.e., a second end of the housing 201.

As described in detail above, locking elements of the plungers 260*b* engage the holes 226 in the bracket 220. To unlock the door 4 and move the door 4 to the second horizontal position, the user much exert a pushing force on the door that is sufficient to overcome the spring force of the locking elements 261*b* of the plungers 260*b* to force the locking elements 261*b* laterally outward and out of engagement from within the holes 226 in the bracket 220.

As the user continues to apply a pushing force to the door 4, the bracket 220 moves toward the upper wall 204*a* or the second end of the housing 101. The bushings 245 are positioned and dimensioned to limit the translation of the door 4 relative to the top wall 204*a* of the housing 201. The user may return the door 4 to the first horizontal position by applying a pulling force to the door 4. The door 4 continues to travel to the first horizontal position until the locking elements of plungers 260*b* engage within the holes 226 in the bracket 220 to lock the door 4 in the first horizontal position.

Upon returning to the first horizontal position, the spring 250 may cause the door 4 to pivot to the vertical position. It is contemplated that the spring may be selected such that the force applied by the spring 250 is sufficient to allow the door 4 to pivot slowly, without assistance from the user to the vertical position. It is also contemplated that the spring may be selected such that the force applied by the spring 250 is insufficient to pivot the door 4 alone, but requires the user to apply a small amount of force to pivot the door, at least to initiate closing the door.

As described in detail above, the user may move the door 4 between the vertical position, the first horizontal position, and the second horizontal position while the rack assembly 10 is in the extended position. To prevent the rack assembly 10 from moving to the retracted position while the door 4 is in the stowed (second horizontal) position, the rack assembly 10 may further include lock assemblies 30 that lock the rack assembly 10 in the extended position.

Figure 16:
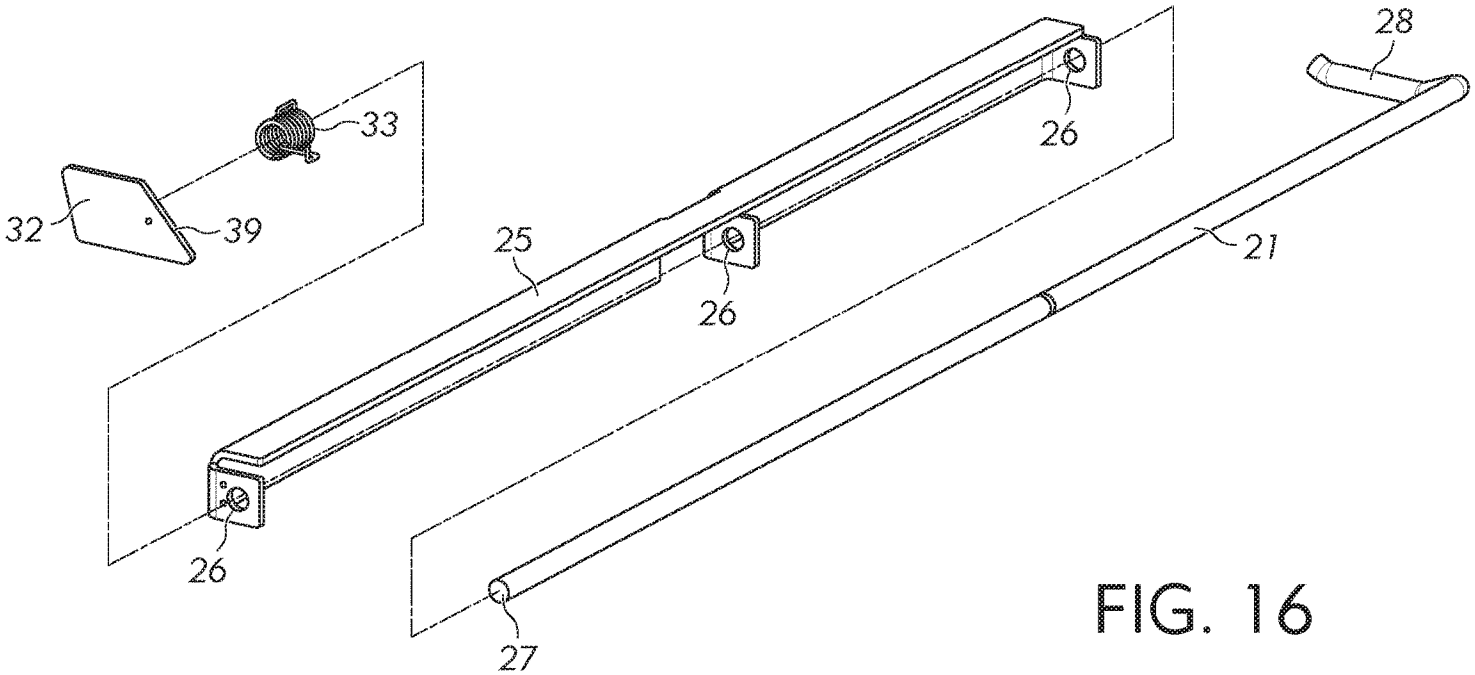
FIG. 16 is an exploded view of a locking assembly according to a second embodiment.

Referring to FIG. 16, the lock assembly 30 contains some of the same components as the lock assembly 20. Particularly, the lock assembly 30 includes a bar 21 having a first end 27 dimensioned to be positioned adjacent the inner panel 4*d* of the door 4, and a second, bent end 28 dimensioned to be received and engaged within a notch 19*a*, 19*b* formed in the respective cavity brackets 18*a*, 18*b* of each slide assembly 13 in order to lock the rack assembly against translation (i.e. retraction within the oven cavity) while the door is stowed. As discussed above with respect to previous embodiments, the notches 19*a*, 19*b* can also be formed in other components of the oven, such as the fixed arms 16*a*, 16*b* of the slide assemblies 13*a*, 13*b* or even directly in the side walls 3*a* of the oven cavity. A bracket 25 includes holes 26 that the bar 21 extends through and rotates within. The lock assembly 30 also includes a tab element 32 having an edge 39 and a spring 33 disposed around the bar 21, which when assembled is effective to bias the second end 28 of the bar 21 out of engagement within the associated notch 19.

Figure 17:
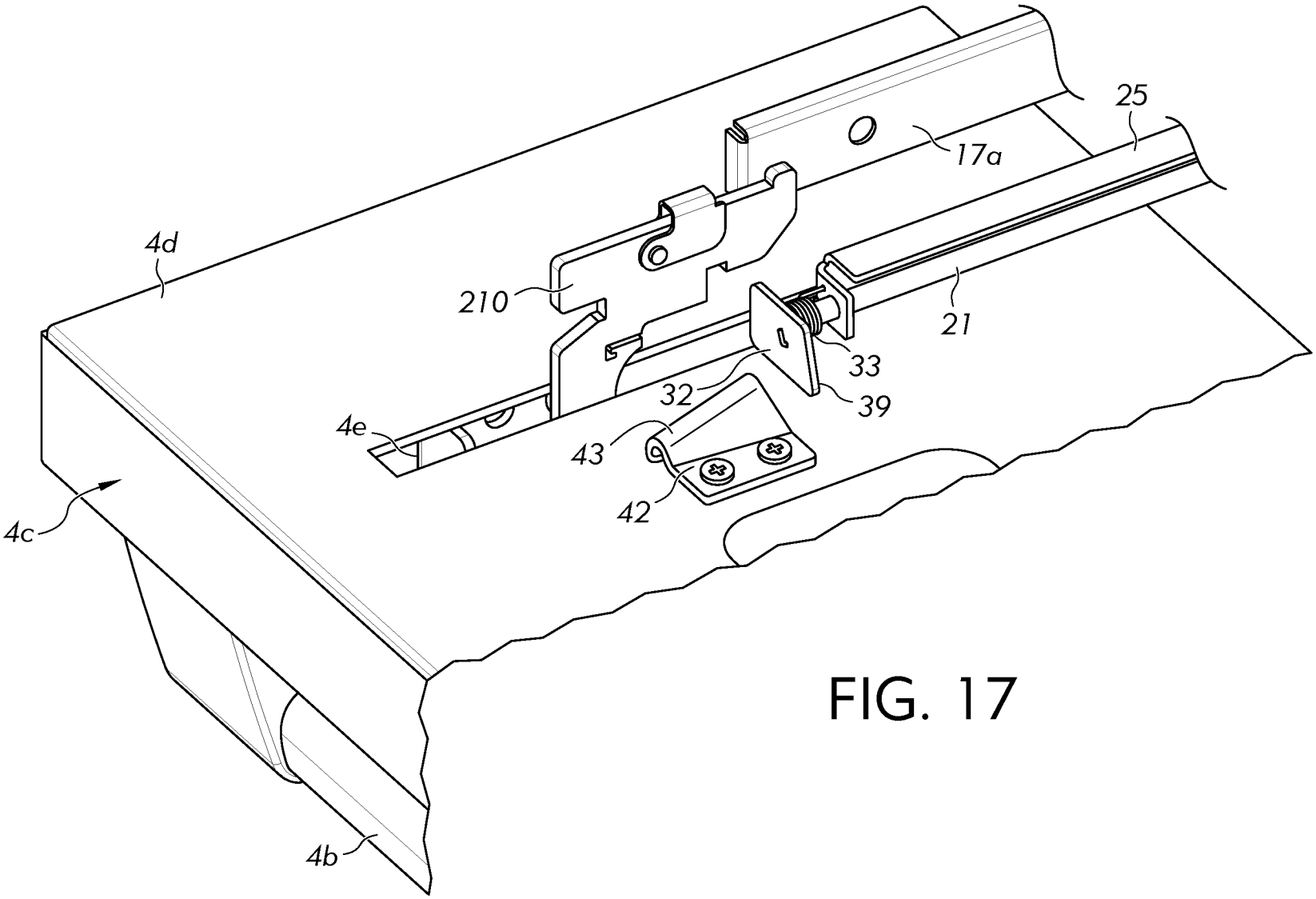
FIG. 17 is an enlarged perspective view of the door of FIG. 11*a* in the first horizontal position with the frame assembly removed for clarity.

Referring to FIG. 17, a bracket 42 is position on the inner panel 4*d* of the door 4 to interact with the tab element 32 of the lock assemblies 30. Specifically, when the door 4 is slid from the first horizontal position (FIG. 18*a*) to the second horizontal (stowed) position (FIG. 18*b*) the door brackets 42 interact with the tab elements 32, thereby causing rotation thereof, and of the terminal bent end 28 thereof, thus engaging the bent end 28 within the associated notch 19 and locking the rack assembly 10 in the open (withdrawn) position when the door 4 is stowed.

Figure 18A:
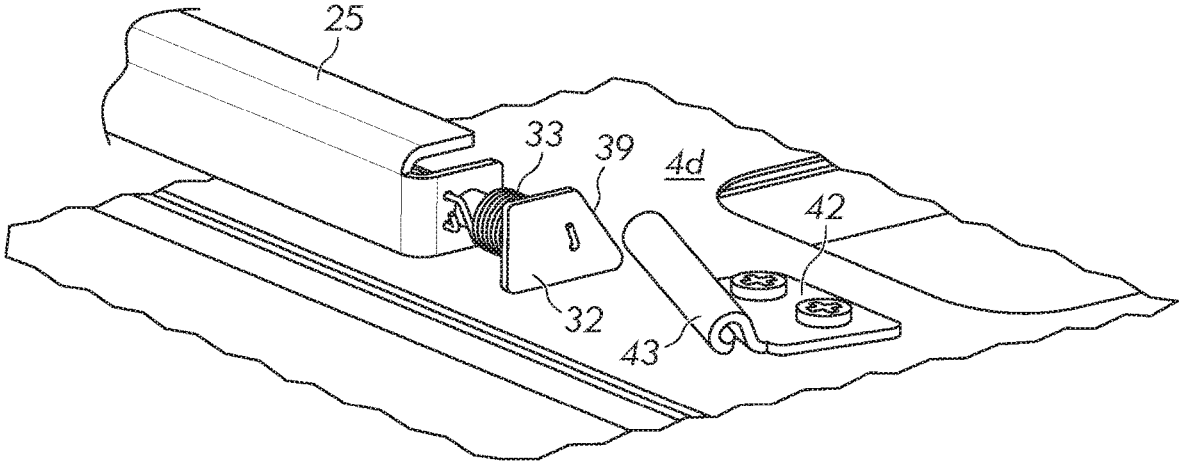
FIG. 18*a* is an enlarged perspective view of the door of FIG. 17 showing an end of the locking assembly of FIG. 16 in an unlocked position.
Figure 18B:
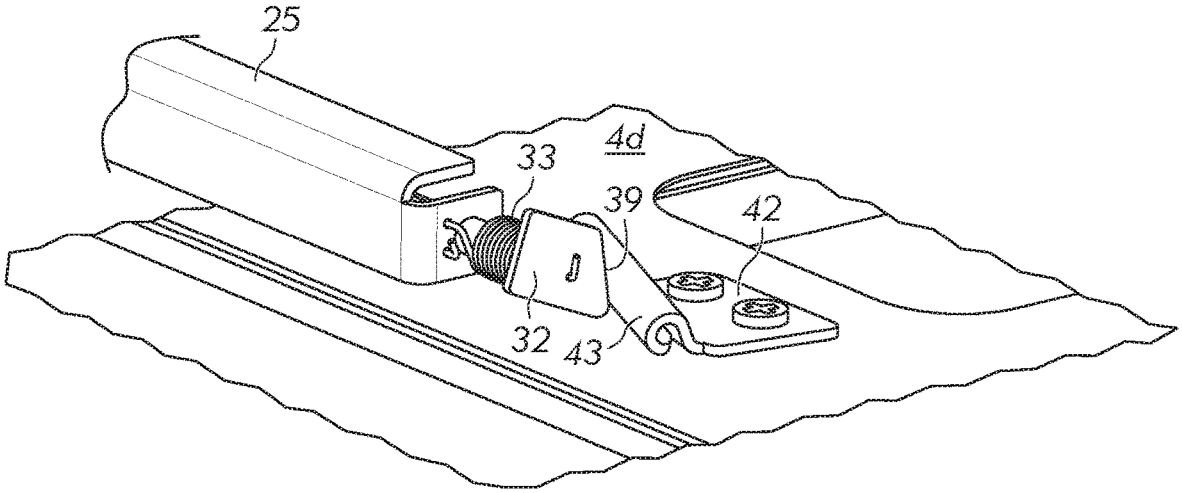
FIG. 18*b* is an enlarged perspective view of the door of FIG. 18*a* showing the end of the locking assembly of FIG. 16 rotated to a locked position.

Specifically, referring to FIGS. 18*a* and 18*b*, as the door 4 slides underneath the frame 12, the brackets 42 and the tab elements 32 interact with each other such the door brackets 42 cause the tab elements 32 to rotate. This rotation is achieved because of the relative shapes and orientations of the brackets 42 and tab elements 32 that interact with each other. Particularly, the bracket 42 has a pushing edge 43 that is dimensioned to engage an edge 39 of the tab element 32 to cause the tab elements 32 and the bar 21 to rotate. As the bar 21 rotates, the bent end 28 of the bar 21 is rotated into engagement within the notch 19 in the cavity bracket 18 (see FIG. 10*b*). The locking assembly 30, thereby prevents the rack assembly 10 from moving to the retracted position. This allows a user to place a food item on to or take a food item off of the cooking rack 11 while the door 4 is in the stowed position without the rack assembly 10 moving back into the oven cavity. When the door 4 is pulled to the first horizontal position, the second end 28 of the bar 21 of the locking assembly 30 rotates out of engagement within the notch 19 in the cavity bracket 18 so that the rack assembly 10 may be slid into the oven cavity 3 (see FIG. 10*a*).

The disclosed embodiments provide locking assemblies for a movable door that prevents a rack assembly attached to the door from moving to a retracted position within the oven cavity while the door is in a preselected position while opened.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims and their equivalents.

What is claimed is:

1. An oven comprising:

a chamber defining an oven cavity with an open front; and a rack assembly slidable relative to the chamber between a retracted position and an extended position; the rack assembly comprising:

a door for closing the open front of the chamber when the rack assembly is in the retracted position;

a hinge assembly attached to the door, the hinge assembly configured to allow the door to slide between a first position and a second position with respect to the chamber;

a slide assembly for spacing the door from the open front of the chamber when the rack assembly is in the extended position; and a lock assembly for locking the rack assembly in the extended position, the lock assembly being moveable between a locked position and an unlocked position, the lock assembly being in the unlocked position when the door is in the first position thereby allowing the rack assembly to freely move between the retracted position and the extended position, and the lock assembly being in the locked position when the door is in the second position thereby locking the rack assembly in the extended position such that the rack assembly cannot be retracted.

2. The oven of claim 1, wherein the second position of the door is vertically below the first position of the door.

3. The oven of claim 1, the lock assembly including a rotatable bar wherein the bar engages a notch fixed relative to the chamber of the oven when the lock assembly is in the locked position, the bar spaced from the notch when the lock assembly is in the unlocked position.

4. The oven of claim 3, the door including a bracket for rotating the bar as the door moves between the first position and the second position.

5. The oven of claim 1, the hinge assembly comprising a housing connected to the door, and an arm connected to the slide assembly, the arm slidable between a first end of the housing and a second end of the housing, wherein when the arm is in the first end of the housing the door is in the first position and when the arm is in the second end of the housing the door is in the second position.

6. The oven of claim 5, the hinge assembly comprising one or more shafts for guiding the arm within the housing between the first end of the housing and the second end of the housing.

7. An oven comprising:

a chamber defining an oven cavity with an open front; and a rack assembly slidable relative to the chamber between a retracted position and an extended position; the rack assembly comprising:

a door for closing the open front of the chamber when the rack assembly is in the retracted position;

a hinge assembly attached to the door, the hinge assembly configured to allow the door to slide between a first position and a second position, the second position being vertically below the first position;

a slide assembly connected to the hinge assembly for spacing the door from the open front of the chamber when the rack assembly is in the extended position; and a lock assembly for locking the rack assembly in the extended position, the lock assembly being moveable between a locked position and an unlocked position, the lock assembly being in the unlocked position when the door is in the first position thereby allowing the rack assembly to freely move between the retracted position and the extended position, and the lock assembly being in the locked position when the door is in the second position thereby locking the rack assembly in the extended position such that the rack assembly cannot be retracted.

8. The oven of claim 7, the lock assembly including a rotatable bar wherein the bar engages a notch fixed relative to the chamber of the oven when the lock assembly is in the locked position, the bar spaced from the notch when the lock assembly is in the unlocked position.

9. The oven of claim 8, the door including a tab for rotating the bar as the door moves between the first position and the second position.

10. The oven of claim 8, the hinge assembly comprising a housing connected to the door, and an arm connected to the slide assembly, the arm slidable between a first end of the housing and a second end of the housing, wherein when the arm is in the first end of the housing the door is in the first position and when the arm is in the second end of the housing the door is in the second position.

11. The oven of claim 10, the hinge assembly comprising one or more shafts for guiding the arm within the housing between the first end of the housing and the second end of the housing.

12. The oven of claim 11, the hinge assembly further comprising one or more springs for biasing the arm toward the first end of the housing.

13. The oven of claim 10, the hinge assembly further comprising one or more locking elements for selectively locking the hinge arm in the first end of the housing and the second end of the housing.

14. An oven comprising:

a chamber defining an oven cavity with an open front; and a rack assembly slidable relative to the chamber between a retracted position and an extended position; the rack assembly comprising:

a door for closing the open front of the chamber when the rack assembly is in the retracted position;

a hinge assembly attached to the door, the hinge assembly configured to allow the door to pivot between a vertical position and a first horizontal position and to slide between the first horizontal position and a second horizontal position;

a slide assembly connected to the hinge assembly for spacing the door from the open front of the chamber when the rack assembly is in the extended position; and a lock assembly for locking the rack assembly in the extended position, the lock assembly being moveable between a locked position and an unlocked position, the lock assembly being in the unlocked position when the door is in the vertical position or the first horizontal position, or between the vertical position and the first horizontal position thereby allowing the rack assembly to freely move between the retracted position and the extended position, and the lock assembly being in the locked position when the door is in the second horizontal position thereby locking the rack assembly in the extended position such that the rack assembly cannot be retracted.

15. The oven of claim 14, the hinge assembly further comprising one or more springs for biasing the door to the vertical position.

16. The oven of claim 14, the lock assembly including a rotatable bar wherein the bar engages a notch fixed relative to the chamber of the oven when the lock assembly is in the locked position, the bar spaced from the notch when the lock assembly is in the unlocked position.

17. The oven of claim 16, the door including a tab for rotating the bar as the door moves between the first horizontal position and the second horizontal position.

18. The oven of claim 14, the hinge assembly comprising a housing connected to the door, and an arm connected to the slide assembly, the arm slidable between a first end of the housing and a second end of the housing, wherein when the arm is in the first end of the housing the door is in the first horizontal position and when the arm is in the second end of the housing the door is in the second horizontal position.

19. The oven of claim 18, the hinge assembly comprising one or more shafts for guiding the arm within the housing between the first end of the housing and the second end of the housing.

20. The oven of claim 18, the hinge assembly further comprising one or more locking elements for selectively locking the hinge arm in the first end of the housing or the second end of the housing.

* * * * *